US006629429B1

(12) United States Patent
Kawamura et al.

(10) Patent No.: US 6,629,429 B1
(45) Date of Patent: Oct. 7, 2003

(54) REFRIGERATOR

(75) Inventors: Takao Kawamura, Shiga (JP); Yoshiki Ohashi, Shiga (JP); Akihiko Manabe, Shiga (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 09/936,236

(22) PCT Filed: Mar. 10, 1999

(86) PCT No.: PCT/JP00/01456

§ 371 (c)(1),
(2), (4) Date: Aug. 18, 2000

(87) PCT Pub. No.: WO00/55554

PCT Pub. Date: Sep. 21, 2000

(30) Foreign Application Priority Data

Mar. 12, 1999 (JP) ..... 11-66383
Apr. 6, 1999 (JP) ..... 11-98575

(51) Int. Cl.[7] ..... F25D 11/02
(52) U.S. Cl. ..... 62/441; 62/447
(58) Field of Search ..... 62/337, 431, 440, 62/441, 447, 498, 338, 239

(56) References Cited

FOREIGN PATENT DOCUMENTS

| | | |
|---|---|---|
| JP | 63-132288 | 8/1988 |
| JP | 4-36588 | 3/1992 |
| JP | 7-286771 | 10/1995 |
| JP | 7-294096 | 11/1995 |
| JP | 9-138050 | 5/1997 |
| JP | 9-250864 | 9/1997 |
| JP | 10-292971 | 11/1998 |
| JP | 10-318653 | 12/1998 |
| JP | 11-44479 | 2/1999 |

*Primary Examiner*—Denise L. Esquivel
*Assistant Examiner*—Malik N. Drake
(74) *Attorney, Agent, or Firm*—Wenderoth, Lind & Ponack, L.L.P.

(57) ABSTRACT

There are provided, in the order from top, a refrigerating compartment (90), a vegetable compartment (91) and a freezing compartment (92), and a compressor (104) and a cooler (106) are disposed in side-by-side relation in a left and right direction at a location rearwardly of the freezing compartment (92). Also, a damper device (115) and a forced draft fan (114) are provided above the compressor (104) and the cooler (106), and an electronic control board (128) is provided rearwardly of the cooler (106). In addition, a chilly air discharge duct (116) and a chilly air suction duct (121) are provided at opposite ends of a deep region within the refrigerating compartment (90).

40 Claims, 15 Drawing Sheets

REFRIGERATOR

TECHNICAL FIELD

The present invention relates to an arrangement of cooling functional elements or control elements in a refrigerator.

BACKGROUND ART

Recently, there is an increasing demand to increase the capacity of refrigerators. On the other hand, the housing problem limits the installation space of a refrigerator and, in order to realize an increase in capacity, it is necessary to reconsider void spaces or spaces having a low practical use within the refrigerator body. By reducing such spaces, it is possible to enhance the volumetric efficiency and increase the effective internal capacity without increasing the installation space.

Various countermeasures have been proposed to enhance the volumetric efficiency. One of the typical countermeasures is to enhance the heat insulating efficiency of a heat insulating material in the refrigerator body to directly increase the internal volume of a cabinet. Another typical countermeasure is to reduce the volume occupied by electronic control boards or cooling functional elements such as a refrigerating cycle, fans, a damper device, cooling ducts, etc. for cooling the cabinet, because such volume is an ineffectual one with respect to a storage space within the cabinet, though the above elements are necessary and indispensable.

Because the former countermeasure depends greatly on a technical development of the heat insulating material itself, the latter has been mainly employed to enhance the mounting efficiency of the cooling functional elements or the control elements.

Japanese Patent Laid-Open Publication No. 8-338681 discloses this kind of conventional refrigerator.

FIG. 16 is a front view of the conventional refrigerator. FIG. 17 is a sectional view of the conventional refrigerator. In FIGS. 16 and 17, 1 denotes a refrigerator body, and 2 denotes a heat insulating partition wall for partitioning the interior of the refrigerator body 1 into upper and lower chambers and having a rising portion 2a on the rear side thereof. 3 denotes a refrigerating compartment and 4 denotes a vegetable compartment formed below the refrigerating compartment 3, both located separately above the heat insulating partition wall 2. 5 denotes an upper freezing compartment and 6 denotes a lower freezing compartment, both located separately below the heat insulating partition wall 2. Further, 7 denotes a low-temperature compartment located below the refrigerating compartment 3 and controlled at a temperature lower than the temperature in the refrigerating compartment 3.

8 denotes a pivoted door mounted on a front opening of the refrigerating compartment 3, and 9, 10, and 11 denote drawer-type doors mounted on front openings of the vegetable compartment 4, the upper freezing compartment 5, and the lower freezing compartment 6, respectively. Further, 12, 13, and 14 denote slidable storage containers secured to the drawer-type doors 9, 10, 11, respectively, and 15 denotes a storage container accommodated within the low-temperature compartment 7. 16 denotes shelves for partitioning the refrigerating compartment 3 into a plurality of storage compartments.

17 denotes a machinery compartment formed at a lower portion and a lower rear portion of the refrigerator body 1.

18 denotes a compressor of a refrigerating cycle disposed inside the machinery compartment and rearwardly of the lower freezing compartment 6, and 19 denotes a condenser disposed below the lower freezing compartment 6. 20 denotes an evaporating dish disposed in a space below the condenser 19 for evaporating water produced by defrosting. 21 denotes a cooler of the refrigerating cycle disposed inside the upper freezing compartment 5 at a rear portion thereof and extending in a vertical direction above the compressor 18. Further, 22 denotes a forced draft fan disposed above the cooler 21 and confronting the rising portion 2a at a location rearwardly of the vegetable compartment 4.

23 denotes an air-duct control panel disposed rearwardly of the vegetable compartment 4 and the low-temperature compartment 7 and accommodating a damper device 24 for regulating the amount of chilly air supplied to the refrigerating compartment 3 and the vegetable compartment 4, a damper device 25 for regulating the amount of chilly air supplied to the low-temperature compartment 7, and an electronic control board 26 for controlling electrically-driven devices such as the compressor 18, the forced draft fan 22, the damper devices 24, 25 and the like.

27 denotes a first chilly-air discharge duct for introducing into the refrigerating compartment 3 chilly air sent from the forced draft fan 22 via the damper device 24. The first chilly-air discharge duct 27 has chilly-air discharge ports 28 defined therein one above another at a central portion of the refrigerating compartment 3 so as to confront the storage compartments between the shelves 16. 29 denotes a second chilly-air discharge duct for introducing the chilly air into the low-temperature compartment 7 via the damper device 24. The second chilly-air discharge duct 29 has a chilly-air discharge port 30 defined therein at a rear portion of the low-temperature compartment 7.

31 denotes a chilly-air suction duct for returning the chilly air from the vegetable compartment 4 to the cooler 21 and having a chilly-air suction port 32 defined therein at a rear portion of the vegetable compartment 4. The chilly air discharged into the refrigerating compartment 3 and the low-temperature compartment 7 circulates from a communication port 33 defined in a lower rear portion of the low-temperature compartment 7 to the chilly-air suction port 32 via a peripheral portion of the storage container 12 of the vegetable compartment.

34 denotes a chilly-air discharge port for discharging the chilly air from the forced draft fan 22 into the upper freezing compartment 5 and the lower freezing compartment 6. The rising portion 2a of the heat insulating wall is positioned in front of the chilly-air discharge port 34 so as to direct the chilly air downwardly. Further, 35 denotes a chilly-air suction port for returning the chilly air to a lower portion of the cooler 21.

36 denotes a temperature detector mounted on a rear wall of the upper freezing compartment 5 for detecting the temperature inside the freezing compartments. 37 denotes a temperature detector mounted on a rear wall of the refrigerating compartment 3 for detecting the temperature inside the refrigerating compartment. 38 denotes a temperature detector mounted on a rear wall of the low-temperature compartment 7 for detecting the temperature inside the low-temperature compartment.

Further, 39 denotes a defrosting heater adjacent to a lower portion of the cooler 21, 40 denotes a drip pan for receiving water produced by defrosting, and 41 denotes a discharge pipe. The discharge pipe 41 communicates the drip pan 40 with the evaporating dish 20.

The operation of the refrigerator of the above-described construction is explained hereinafter.

When the temperature detected by the temperature detector 36 is higher than a set value, the compressor 18 is operated, and chilly air cooled by the cooler 21 is caused to forcibly flow by the forced draft fan 22 and is discharged into the upper freezing compartment 5 and the lower freezing compartment 6 via the chilly-air discharge port 34. Thereafter, the chilly air is returned to the cooler 21 via the chilly-air suction port 35. When the temperature detected by the temperature detector 36 becomes lower than the set value, the compressor 18 is stopped. Such operations are repeatedly carried out, and the interior of the freezing compartments is cooled to, for example, a freezing temperature of −18° C.

When the temperatures detected by the temperature detectors 36, 37 are higher than respective set values, the damper device 24 is opened, and the chilly air cooled by the cooler 21 is caused to forcibly flow by the forced draft fan 22 and is discharged into the refrigerating compartment 3 via the first chilly-air discharge duct 27 and the chilly-air discharge ports 28. The chilly air that has cooled the interior of the refrigerating compartment 3 flows into an upper portion of the vegetable compartment 4 via the communication port 33 and indirectly cools the interior of the vegetable compartment 4 through the storage container 12. The chilly air then passes through the chilly-air suction port 32 and the chilly-air suction duct 31 before it returns to the cooler 21. Thereafter, when the temperature detected by the temperature detector 37 becomes lower than the set value, the damper device 24 is closed. Such operations are repeatedly carried out, and the interior of the refrigerating compartment 3 is cooled to, for example, a refrigerating temperature of 4° C., while the interior of the vegetable compartment 4 is cooled to, for example, a refrigerating temperature of 6° C.

When the temperatures detected by the temperature detectors 36, 38 are higher than respective set values, the damper device 25 is opened, and the chilly air cooled by the cooler 21 is caused to forcibly flow by the forced draft fan 22 and is discharged into the low-temperature compartment 7 via the second chilly-air discharge duct 29 and the chilly-air discharge port 30. The chilly air that has cooled the interior of the low-temperature compartment 7 flows into an upper portion of the vegetable compartment 4 via the communication port 33 and indirectly cools the interior of the vegetable compartment 4 through the storage container 12. The chilly air then passes through the chilly-air suction port 32 and the chilly-air suction duct 31 before it returns to the cooler 21. Thereafter, when the temperature detected by the temperature detector 38 becomes lower than the set value, the damper device 25 is closed. Such operations are repeatedly carried out, and the interior of the low-temperature compartment 7 is cooled to, for example, a chilling temperature of 0° C. or a partially freezing temperature of −6° C.

On the other hand, from the viewpoint of the mounting efficiency of the cooling functional elements or the control elements, the cooler 21 as a cooling source is disposed unevenly with respect to the vegetable compartment 4 having a high inner temperature and is located adjacent to and rearwardly of the upper freezing compartment 5 having a lowest inner temperature, making it possible to reduce a temperature drop inside the vegetable compartment 4 and effectively cool the upper freezing compartment 5 and the lower freezing compartment 6.

In particular, because the upper freezing compartment 5 and the lower freezing compartment 6 are disposed at a lower portion of the refrigerator body 1, it is inevitably possible to lower the position of the cooler 21, thus eliminating a dead space between the machinery compartment 17 and the cooler 21. Further, because the positions of the forced draft fan 22 and the damper devices 24, 25 disposed above the cooler 21 can be lowered, the mounting efficiency can be enhanced and the effective utilization of the interior of the cabinet can be achieved. In addition, the center of gravity of the refrigerator body 1 can be lowered, enhancing the stability.

Also, because the electronic control board 26 for controlling the electric parts is not disposed at an upper rear portion of the refrigerator body 1 but is accommodated within the air-duct control panel 23 at a central portion of the cabinet, the distances between it and the electric parts such as the compressor 18, the forced draft fan 22, the damper devices 24, 25, the defrosting heater 39 and the like, all of which are positioned substantially below the center of the refrigerator body, are reduced as compared with those in the conventional refrigerators, making it possible to reduce the cost for wiring and the assembling work.

In the above-described conventional construction, however, because the compressor 18 is accommodated within the machinery compartment 17 that is formed rearwardly of the lower freezing compartment 6 and extends over the full width thereof, there arises a problem in that a large dead space is created within the machinery compartment 17 in the direction widthwise thereof.

Further, because the cooler 21 is disposed above the compressor 18, if the cooler 21 is so designed as to have a height enough to provide a sufficient cooling capacity, an upper end surface of the cooler 21 inevitably reaches the heat insulating partition wall 2. As a result, the forced draft fan 22 disposed adjacent to an upper portion of the cooler 21 is positioned above the upper freezing compartment 5 and, hence, the heat insulating partition wall 2 must have the rising portion 2a extending upwardly from a rear portion thereof so as to insulate the forced draft fan 22 and the vegetable compartment 4 from each other, thus complicating the construction and increasing the ineffectual volume.

Also, the arrangement in which the rising portion 2a of the heat insulating partition wall 2, the forced draft fan 22, and the air-duct control panel 23 are disposed rearwardly violates the depth of the low-temperature compartment 7 and reduces the storage capacity thereof. That is, the storage compartment that is positioned substantially at a central level of the refrigerator and is, hence, easiest to use comes to have a reduced capacity.

In order for such a refrigerator to ensure the capacity of the cabinet, it is necessary to increase the depth of the refrigerator body 1, for example. However, if the refrigerator protrudes from a cupboard adjacent thereto, the indoor appearance is deteriorated.

Further, because the condenser 19 and the evaporating dish 20 are disposed one above the other inside a bottom portion of the refrigerator body 1, the bottom portion must have a height enough to ensure the heat radiating capacity of the condenser 19 and the evaporating capacity of the evaporating dish 20, thus violating the space for the storage compartment and reducing the volumetric efficiency.

Also, because the chilly-air discharge duct 27 is provided at a central portion of the refrigerator 3, it protrudes toward and violates the central portion of the cabinet that is easy to use. In order to enhance the value of goods, if the entire rear wall of the refrigerating compartment including the protrusion at the central portion is covered with an ornamental cover, the ineffectual space is further increased. Further, because the chilly air discharge is conducted from a plurality of discharge ports formed at the central portion, while the chilly air suction is conducted through only the communication port 33 formed at a lower portion of the refrigerating compartment, there arises a problem in that temperature variations are likely to occur in the horizontal direction inside the refrigerating compartment 3.

Although the position of the electronic control board 26 is improved as compared with that in the conventional refrigerators in which it is located at an upper rear portion of the refrigerator body, it is still distant from the compressor 18, the defrosting heater 39 and the like. Accordingly, the length of electric wires cannot be sufficiently shortened.

The present invention has been developed to overcome the above-described disadvantages, and a first objective of the present invention is to provide a refrigerator having an enhanced volumetric efficiency, an increased storage capacity and an enhanced stability by enhancing the mounting efficiency of the cooling functional elements and the control elements.

A second objective of the present invention is to provide a refrigerator having an increased storage capacity in an easy-to-use region positioned at a central level of the refrigerator.

A third objective of the present invention is to provide a refrigerator in which the electronic control boards are arranged efficiently to thereby simplify the arrangement of electric wires.

A fourth objective of the present invention is to provide a refrigerator capable of suppressing temperature variations within the refrigerator.

DISCLOSURE OF THE INVENTION

In accomplishing the above and other objectives, the refrigerator of the present invention is a refrigerator which comprises a refrigerating cycle including a compressor, a condenser and a cooler, and a refrigerator body having a storage compartment defined therein, and in which the compressor and the cooler are disposed on left and right sides at a location rearwardly of the storage compartment. By this construction, a void space in a widthwise direction that is formed by biasing the compressor towards one side is used as a space for installation of the cooler with the height of installation of the cooler consequently lowered. As a result thereof, the mounting efficiency of the refrigerating cycle can be increased, the inner volumetric efficiency can be increased, and the preserving ability and the stability can be enhanced.

The present invention can be equally applied to a refrigerator wherein the refrigerator body has a plurality of storage compartments defined therein. In such case, by disposing the compressor and the cooler on left and right sides at a location rearwardly of one of the storage compartments, the storage capacity and the easiness to use can be increased without invading a deep space of the other compartments.

If the compressor and the cooler are disposed rearwardly of the lowermost storage compartment, the refrigerator having a lower center of gravity and, hence, a stability can be provided.

Also, the storage compartments may include two compartments located within the refrigerator body on left and right sides thereof. In such case, because the compressor and the cooler are disposed on left and right sides at a location rearwardly of the two storage compartments, the void space in the widthwise direction within the refrigerator of a type having a relatively large width can be effectively utilized to increase the freedom of design of cooling functional component parts.

If the compressor and the cooler are so disposed as to confront rearwardly of the respective compartments, any possible influence brought on the deep space for storage of the compressor can be limited to one compartment and the easiness-to-use can be increased.

If the compressor and the cooler are positioned at a lower rear region of the storage compartment, the refrigerator can have a lower center of gravity with the stability thereof consequently increased.

If the refrigerator body is further provided with a machinery compartment and a cooling compartment positioned on left and right sides, respectively, with a heat insulating wall positioned therebetween, and the compressor and the cooler are accommodated within the machinery compartment and the cooling compartment, respectively, the void space in the widthwise direction that is created by biasing the machinery compartment to one side can be used as a cooling compartment for installation of the cooler. Accordingly, the height of installation of the cooler can be lowered to thereby increase the effective inner volume of the refrigerator.

If a bottom end surface of the cooler is positioned at a level lower than an upper end surface of the compressor, the height of installation of the cooler can further be lowered, making it possible to prevent the other compartment space from being influenced and to further reduce the size thereof.

If a forced draft fan is provided in the cooling compartment for supplying a forced draft of air to the storage compartment and is positioned rearwardly of the storage compartment provided with the cooler, the cooling functional component parts including the compressor and the cooler can be collected without the other compartments being invaded and no complicated partitioning structure relative to the other compartments is needed.

Also, if a damper device is provided for controlling an amount of chilly air to be supplied to at least one of the storage compartments and is positioned rearwardly of the storage compartment confronting the compressor, the cooling functional component parts including the compressor, the cooler and the damper device can be collected at one location to thereby reduce the size and, therefore, the assembling ability during the manufacturing process and the capability of dismantling at the time of discard can be increased.

Furthermore, if the forced draft fan is disposed above the cooler and the damper device is disposed above the compressor, a space rearwardly above the freezing compartment can be utilized to efficiently install an air passage, allowing the void space to be effectively utilized.

If the forced draft fan is disposed at a location adjacent an upper portion of the cooler so as to extend obliquely upwardly, the height of the cooling compartment can be further suppressed, resulting in a reduction in size.

Also, if the plural storage compartments have at least refrigerating and freezing compartments, the damper device controls the amount of chilly air to be supplied to the refrigerating compartment, and the compressor and the cooler are disposed rearwardly of the freezing compartment, the freezing compartment having the lowest temperature can be positioned in the vicinity of the cooler to thereby increase the cooling efficiency.

If the refrigerating compartment is formed at an upper portion of the refrigerator body and the freezing compartment is formed at a lower portion of the refrigerator body, the stability can be increased with a disposition of the high cooling efficiency, and the easiness-to-use can be increased without the deep space of the highly frequently used refrigerating compartment being adversely affected.

If a vegetable compartment is formed below the refrigerating compartment and an amount of chilly air to be supplied to the refrigerating compartment and the vegetable compartment is controlled by the damper device, the depthwise space of the vegetable compartment at a position intermediate of the height easy to use can be secured sufficiently.

If the cooler is positioned rearwardly of the freezing compartment and the forced draft fan is disposed at a location upwardly rearwardly of the freezing compartment, even where the height of the freezing compartment is further limited, the cooling functional component parts can be integrated, making best use of the efficient inner volume.

Also, if an electronic control board is disposed rearwardly of the cooler, electric wiring can be integrated at an area adjacent electric component parts and can therefore be shortened and simplified, making it possible to provide the refrigerator having an excellent assembling ability and economic aspect.

If the electronic control board is accommodated within an electric component storage recess formed in the heat insulating wall rearwardly of the cooler, it is possible to install the electronic control board without being protruding outwardly from the rear of the body and, therefore, there is no possibility that an ineffectual space may be formed in the depthwise direction.

If an evaporating dish is disposed below the cooler for receiving defrosted water from the cooler, a drain passage can be simplified. Accordingly, because even when the position of the cooler is lowered, the defrosted water can be discharged in a vertical direction and stored, the evaporating dish can be provided without the height of the machinery compartment increased.

If an additional forced draft fan is provided for forcibly cooling the compressor within the machinery compartment, the machinery compartment having a relatively small space volume can secure a required amount of heat radiation.

If the condenser is disposed within the machinery compartment and is forcibly cooled by a fan, the cooling functional component parts can be efficiently integrated while securing the capability of a high-pressure side cooling system.

If the condenser is disposed at a bottom of the refrigerator body and is forcibly cooled by the forced draft fan, a space at the bottom of the refrigerator body can be utilized effectively.

If the evaporating dish is disposed in a passage for flow of the air induced by the forced draft fan, evaporation of the defrosted water can be promoted by the effect of a forced air draft induced by the fan.

Also, if the compressor and the evaporating dish are disposed upstream and downstream of the forced draft fan, respectively, and heat of the compressor is guided towards the evaporating dish, evaporation of the defrosted water can further be promoted by the effect of flow of heat from the high-temperature compressor.

Alternatively, if a portion of the condenser is disposed at a position where the evaporating dish is heated, heating of the evaporating dish can be promoted, allowing an evaporating power to be secured even with a small evaporating dish.

If a chilly air discharge duct communicating between the damper device and the refrigerating compartment is disposed vertically at a position adjacent one lateral end of a deep region of the refrigerating compartment and a chilly air suction duct leading to the cooler is disposed vertically at a position adjacent the opposite lateral end of the deep region of the refrigerating compartment, a central space that is easy to use is increased, accompanied by an enhancement in easiness-to-store.

Also, if a chilly air discharge port provided in the chilly air discharge duct and a chilly air suction port provided in the chilly air suction duct are formed adjacent respective lateral ends of the refrigerating compartment, the chilly air circulates in a widthwise direction inside the refrigerator to thereby reduce a temperature variation within the refrigerator compartment, allowing the preserving ability for food materials to be increased.

If a second forced draft fan for circulating air inside the refrigerating compartment is employed, air inside the refrigerating compartment can be circulated and stirred to thereby reduce the temperature variation and temperature increase within the compartment, allowing the preserving ability for food materials to be further increased.

Also, if an electric component cover of the compressor is disposed so as to be oriented towards an open side rearwardly of the machinery compartment, no space is required for removal and fitting of the electric component cover in the widthwise direction of the compressor. Accordingly, the width of the machinery compartment can be shortened with the void space consequently reduced.

Alternatively, the electric component cover of the compressor may be disposed at a location laterally of the machinery compartment. In such case, an opening and a cover for covering the opening may be provided at a portion confronting the electric component cover. Because no distance to a side surface of the machinery compartment is needed during removal and fitting of the electric component cover, the width of the machinery compartment can be shortened with the void space consequently reduced.

If piping for the refrigerating cycle is accommodated rearwardly of an outdoor side of the cooling compartment, effective utilization is possible without the space for the machinery compartment being invaded.

If there is provided a fixture for fixing a dryer and a condenser piping of the refrigerating cycle to an outdoor rear surface of the refrigerating compartment, the fitting workability can be increased and high-pressure piping can be neatly arranged.

If a resinous molded product is used for an external shell forming the machinery compartment, a complicated shape including the machinery compartment can be integrally molded, making it possible to provide the refrigerator having an excellent economic aspect.

In addition, if the resinous molded product used for the external shell forming the machinery compartment is formed integrally with a fixture for fixing a dryer and a condenser piping of the refrigerating cycle, the piping can be fixed without the separate fixture being fitted, thereby increasing the assembling ability.

Also, if the resinous molded product used for the external shell forming the machinery compartment is formed integrally with a holder for holding the evaporating dish that receives defrosted water, the evaporating dish can be fixed with no need to use the separate holder, thereby achieving an economic improvement.

Also, the refrigerator of the present invention is characterized by comprising a refrigerating compartment, a vegetable compartment defined below the refrigerating compartment, a freezing compartment separated from the vegetable compartment by a heat insulating partition wall disposed below the vegetable compartment, a machinery compartment defined adjacent one of opposite sides and rearwardly of the freezing compartment, a cooling compartment defined adjacent the other of the opposite sides and separated from the machinery compartment by a heat insulating wall, a compressor disposed within the machinery compartment, a cooler disposed within the cooling compartment, a forced draft fan disposed within the cooling compartment at a location adjacent an upper portion of the cooler, a damper device disposed rearwardly of the freezing compartment for controlling an amount of chilly air to be supplied to the refrigerating and vegetable compartments, and an electronic control board provided rearwardly of the cooling compartment. The compressor and the cooler are juxtaposed in a side-by-side fashion in a leftward and rightward direction.

With this structure, the cooling functional component parts and control component parts are integrated rearwardly of the freezing compartment in a lower region, accompanied by increase of the mounting efficiency and reduction of the void space within the refrigerator body. Also, the cooling functional component parts and control component parts are excluded from a lower region of the refrigerating compartment and the vegetable compartment at a central region that is easy to use and a storage space increases deep into the refrigerator body and, therefore, the inner volumetric efficiency can be increased.

If there are provided a multipurpose compartment defined above the heat insulating partition wall and a second damper device disposed rearwardly of the freezing compartment for controlling an amount of chilly air to be supplied to the multipurpose compartment, the cooling functional component parts and control component parts are integrated rearwardly of the freezing compartment in a lower region and the void space within the refrigerator body can be reduced. Also, the cooling functional component parts and control component parts are excluded from a lower region of the refrigerating compartment and the vegetable compartment at a central region that is easy to use and a storage space increases deep into the refrigerator body and, therefore, the inner volumetric efficiency can be increased. In addition, the temperature inside the multipurpose compartment is independently controlled and a temperature zone appropriate to the food materials stored can be selected by the user, accompanied by increase of the easiness-to-use.

Also, if there are further provided a chilly air discharge duct provided vertically at a location adjacent one side end of a deep region of the refrigerating compartment in communication with the damper device, a chilly air discharge port provided in the chilly air discharge duct within the refrigerating compartment, a chilly air suction duct provided vertically at a location adjacent the opposite side end of the deep region of the refrigerating compartment for communicating between the refrigerating compartment and the cooler, a chilly air suction port provided in the chilly air suction duct within the refrigerating compartment, and a chilly air suction port provided within the vegetable compartment in communication with the chilly air suction duct, the structural space of the passage for cooling the refrigerating compartment will not invade the effective space at a central area of the compartment that is easy to handle and any possible cooling variation inside the refrigerating compartment can be reduced as a result of the chilly air circulated in the widthwise direction of the compartment as a whole, thereby increasing the capability of the food materials to be stored. In addition, a chilly air duct for the vegetable compartment can easily be formed merely by communicating the chilly air suction port of the vegetable compartment to an intermediate portion of the chilly air suction duct for the refrigerating compartment.

Also, there may be further provided a chilly air discharge duct provided vertically at a location adjacent one side end of a deep region of the refrigerating compartment in communication with the damper device, a chilly air discharge port provided in the chilly air discharge duct within the refrigerating compartment, a second chilly air discharge duct communicating between the second damper device and the multipurpose compartment, a chilly air discharge port provided in the second chilly air discharge port for the multipurpose compartment, a chilly air suction duct provided vertically at a location adjacent the opposite side end of the deep region of the refrigerating compartment for communicating between the refrigerating compartment and the cooler, a chilly air suction port provided in the chilly air suction duct within the refrigerating compartment, a chilly air suction port provided within the vegetable compartment in communication with the chilly air suction duct, a second chilly air suction duct communicating between the multipurpose compartment and the cooler, and a chilly air suction port provided in the multipurpose compartment and communicated with the second chilly air suction duct. Similarly, even in this case, the structural space of the passage for cooling the refrigerating compartment will not invade the effective space at a central area of the compartment that is easy to handle and any possible cooling variation inside the refrigerating compartment can be reduced as a result of the chilly air circulated in the widthwise direction of the compartment as a whole, thereby increasing the capability of the food materials to be stored. In addition, a chilly air duct for the vegetable compartment can easily be formed merely by communicating the chilly air suction port of the vegetable compartment to an intermediate portion of the chilly air suction duct for the refrigerating compartment. Moreover, because the passage is constructed independent of the multipurpose compartment, the independence of the temperature control can be enhanced.

If there are further provided heat insulating partition walls above and below the multipurpose compartment, and if it is used as a temperature changeover compartment, the temperature inside the multipurpose compartment can be adjusted to a value ranging from refrigeration to freezing. As a result, the freedom of selection by the user relative to the amounts of many compartments of fixed temperature zones can be increased, accompanied by the convenience.

BEST MODE FOR CARRYING OUT THE INVENTION

Several embodiments of a refrigerator according to the present invention are explained hereinafter with reference to the drawings.

(Embodiment 1)

Figure 1:
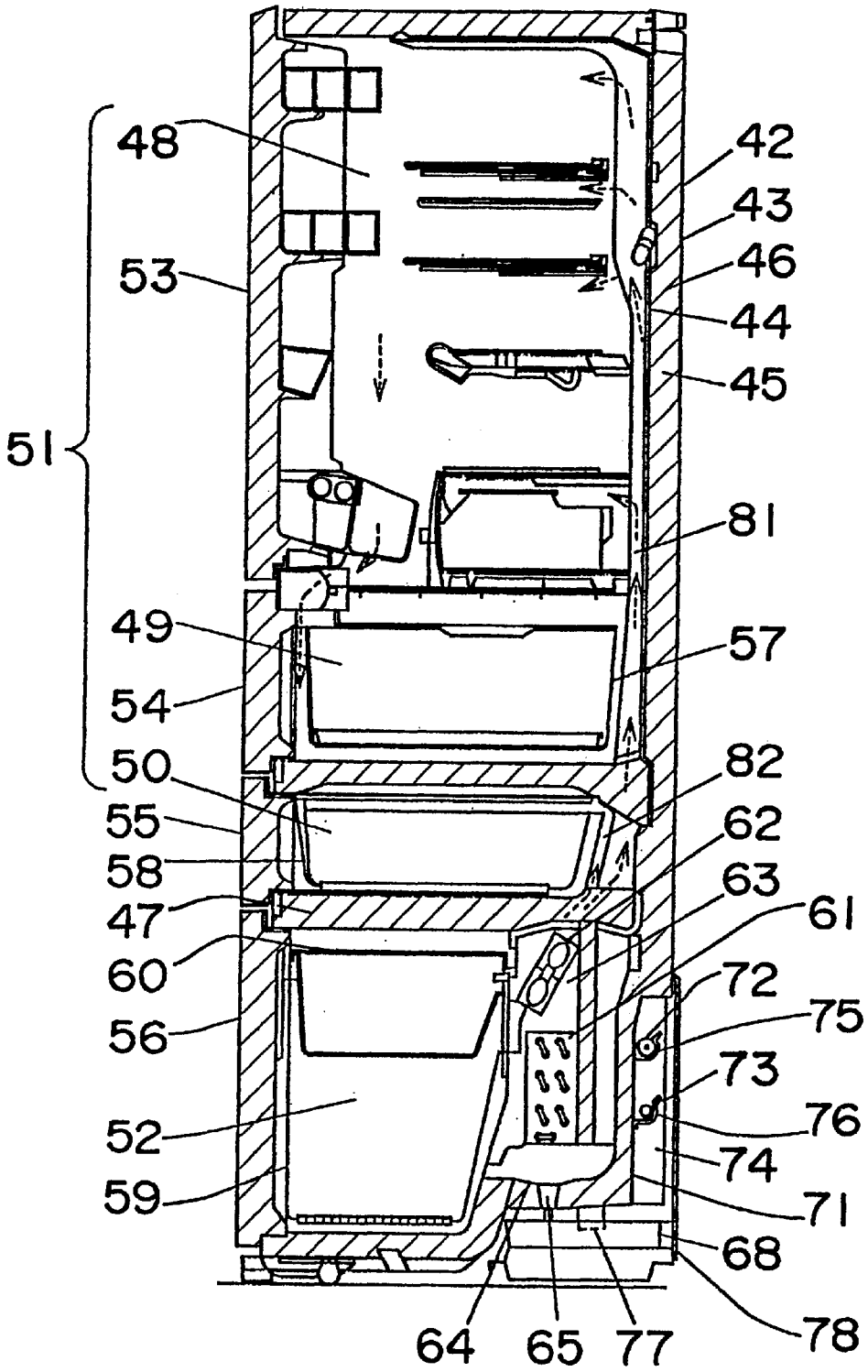
FIG. 1 is a sectional view of a refrigerator according to a first embodiment of the present invention.
Figure 2:
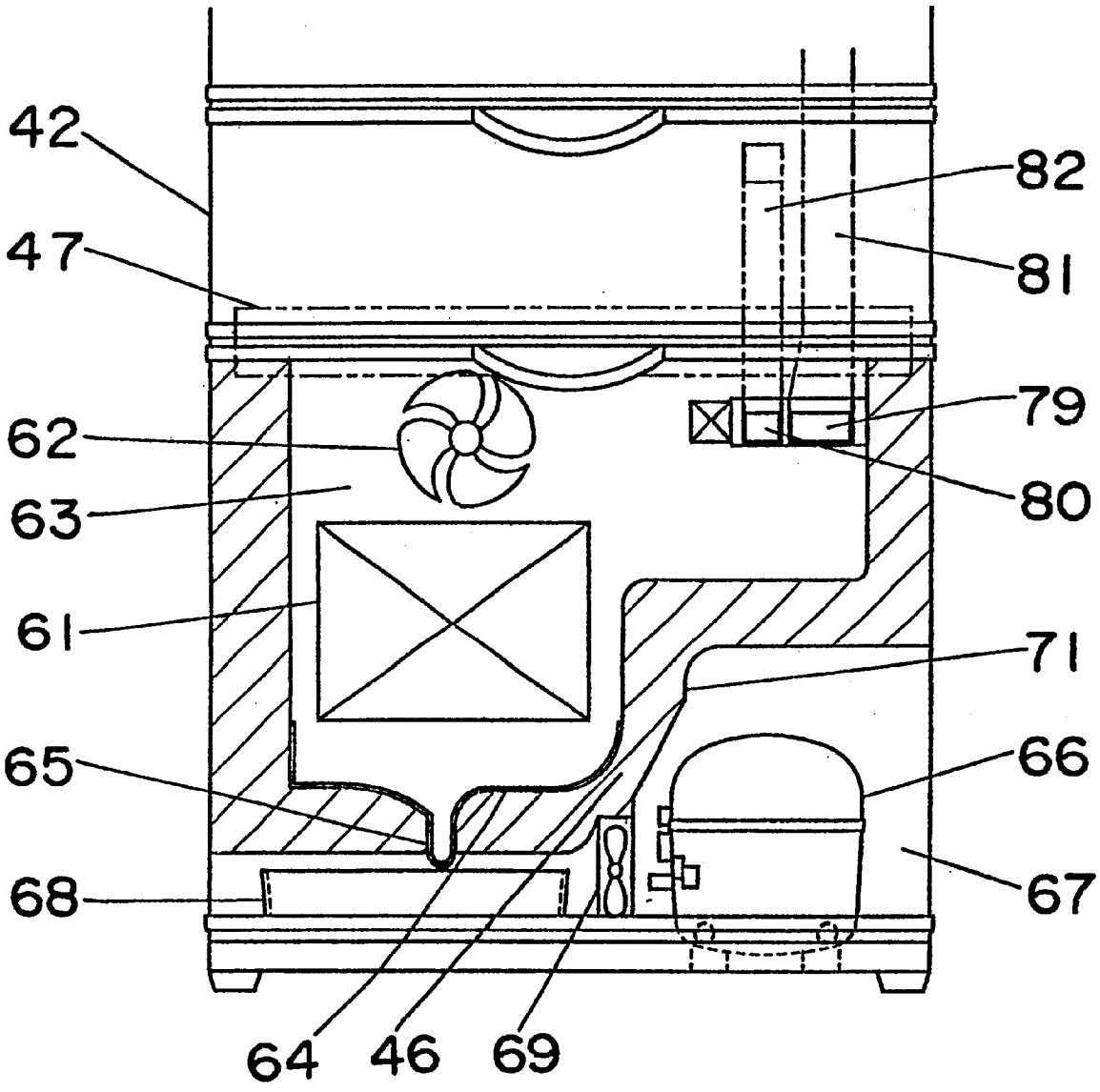
FIG. 2 is a sectional view of an essential portion of the refrigerator of FIG. 1.
Figure 3:
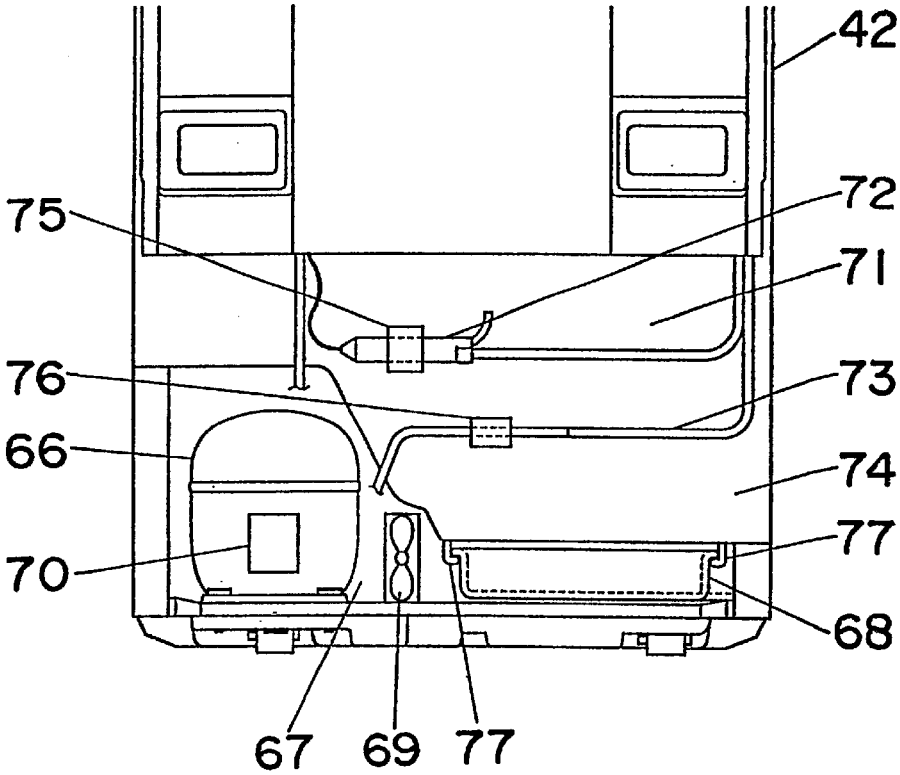
FIG. 3 is a rear view of the essential portion of the refrigerator of FIG. 1.

FIG. 1 is a sectional view of a refrigerator according to a first embodiment of the present invention. FIG. 2 is a sectional view of an essential portion of the refrigerator according to the same embodiment. FIG. 3 is a rear view of the essential portion of the refrigerator according to the same embodiment.

In FIGS. 1 to 3, 42 denotes a refrigerator body comprised of an external box 43 made of a steel plate, an internal box 44 made of a resin, and a heat insulating wall 46 formed by foaming or expanding a heat insulating material in a space between the external box 43 and the internal box 44. 47 denotes a heat insulating partition wall for partitioning the interior of the refrigerator body 42 into upper and lower storage chambers. The upper storage chamber 51 includes a refrigerating compartment 48, a vegetable compartment 49, and a temperature changeover compartment 50 capable of changing over a temperature zone to allow both freezing and refrigerating, all of which are formed in this order from above. The lower storage chamber 52 (hereinafter referred to as a freezing compartment 52) has a refrigerating temperature zone.

53 denotes a pivoted door for the refrigerating compartment 48, while 54, 55 and 56 denote drawer-type doors for the vegetable compartment, the temperature changeover compartment, and the freezing compartment, respectively. 57 denotes a storage container that is drawn out together with the drawer-type door 54 for the vegetable compartment, 58 denotes a storage container that is drawn out together with the drawer-type door 55 for the temperature changeover compartment, 59 denotes a storage container that is drawn out together with the drawer-type door 56 for the freezing compartment, and 60 denotes an upper storage container mounted above the storage container 59.

A cooling compartment 63 accommodating a cooler 61 of a refrigerating cycle and a forced draft fan 62 disposed adjacent to an upper portion of the cooler 61 is formed rearwardly of the freezing compartment 52 on one side thereof. The forced draft fan 62 is inclined so as to extend obliquely upwardly. 64 denotes a drip pan disposed at a bottom portion of the cooling compartment 63 for receiving water produced by defrosting the cooler 61, and 65 denotes a discharge pipe extending through the heat insulating wall 46 from the drip pan 64 and led outside a room. On the other hand, a machinery compartment 67 accommodating a compressor 66 is formed rearwardly of the freezing compartment 52 on the other side thereof, with the heat insulating wall 46 interposed between it and the cooling compartment 63.

The cooler 61 and the compressor 66 are juxtaposed with each other in a side-by-side fashion with the heat insulating wall 46 interposed therebetween. That is, the cooler 61 is not disposed immediately above the compressor 66, and they are separated from each other in the widthwise direction of the refrigerator body 42. Although the compressor 66 is generally disposed adjacent to a bottom portion or a lowermost portion of the refrigerator body 42, the level of a lower end of the cooler 61 does not always fall within the height of the compressor 66 because a space for accommodating the heat insulating wall 46 and the drip pan 64 must be formed below the cooler 61.

68 denotes an evaporating dish disposed below the cooling compartment 63 at a bottom portion of the refrigerator body 42, and the discharge pipe 65 is open to the evaporating dish 68. 69 denotes a forced draft fan disposed within the machinery compartment 67 and between the compressor 66 and the evaporating dish 68 for cooling the compressor 66 and, hence, the compressor 66 and the evaporating dish 68 are placed in an airway from the forced draft fan 69. 70 denotes a cover for electric elements on the compressor 66, which is oriented to the open side rearwardly of the machinery compartment 67.

An external shell that forms a bottom portion and a lower rear portion of the refrigerator body 42 and also forms the shape of the machinery compartment 67 is unitarily formed from a thermoplastic resin and constitutes a machinery compartment panel 71. 72 denotes a dryer of the refrigerating cycle, and 73 denotes a condensation pipe extending from the compressor 66 to the dryer 72. The dryer 72 and the condensation pipe 73 are disposed rearwardly of the cooling compartment 63 and accommodated within a space 74 defined by the machinery compartment panel 71. The dryer 72 and the condensation pipe 73 are fixed by hooked fixing members 75, 76 integrally formed with the machinery compartment panel 71. 77 denotes a rail-shaped holder integrally formed with a lower portion of the machinery compartment panel 71 for holding the evaporating dish 68. 78 denotes a rear cover for covering the machinery compartment 67 and the space 74.

79 and 80 denote damper devices juxtaposed with each other on one side of the forced draft fan 62 within the cooling compartment 63. The damper device 79 controls the amount of cooling or chilly air supplied to the refrigerating compartment 48 and the vegetable compartment 49, while the damper device 80 controls the amount of chilly air supplied to the temperature changeover compartment 50. 81 denotes a chilly-air discharge duct extending from the damper device 79 to the refrigerating compartment 48, and 82 denotes a chilly-air discharge duct extending from the damper device 80 to the temperature changeover compartment 50.

The operation of the refrigerator of the above-described construction is explained hereinafter.

Chilly air produced by the cooler 61 is first discharged into the freezing compartment 52 by the forced draft fan 62 to cool the interior thereof to a freezing temperature (for example, −18° C.). Under the control of the damper device 79, part of the chilly air is then discharged into the refrigerating compartment 48 through the chilly-air discharge duct 81. Similarly, under the control of the damper device 80, the remaining chilly air is discharged into the temperature changeover compartment 50 through the chilly-air discharge duct 82. The chilly air introduced into the refrigerating compartment 48 cools the interior thereof to a refrigerating temperature (for example, 4° C.) and is then introduced into the vegetable compartment 49 to cool the interior thereof to a predetermined temperature (for example, 6° C.). On the other hand, the chilly air introduced into the temperature changeover compartment 50, cools the interior thereof to a desired temperature (for example, a freezing temperature of −18° C., a partially freezing temperature of −3° C., a chilling temperature of 0° C., a refrigerating temperature of 4° C. or the like) in a temperature zone allowing both the freezing and the refrigerating depending on the selection by a temperature regulator (not shown).

In regard to the arrangement of the refrigerating cycle, the compressor 66 is off to the side from the vertical centerline of the refrigerator body 42. As a result of reducing the ineffectual space within the machinery compartment 67, the width of the machinery compartment 67 is reduced to half the width of the refrigerator body 42. In consideration of the depth and height with which the cooling capacity is maintained, the cooler 61 is accommodated within the space newly created on the inner side of the refrigerator body 42 by reducing the ineffectual space.

As a result, the compressor 66 and the cooler 61 are disposed in a side-by-side fashion with the heat insulating wall 46 interposed therebetween. This arrangement makes it possible to minimize an ineffectual space in the widthwise direction of the refrigerator, which space has hitherto been created by placing the cooler 61 above the compressor 66, thus increasing the effective storage capacity.

With the side-by-side arrangement of the compressor 66 and the cooler 61, both of which are heavy, the center of gravity of the refrigerator body 42 becomes lower than that of the conventional one, enhancing the stability.

Further, because the level of the cooler 61 and that of the forced draft fan 62 disposed above the cooler 61 are both lowered, a rear space of the vegetable compartment 49 and the temperature changeover compartment 50 is not violated and, hence, the storage container 57 in the vegetable compartment 49 and the storage container 58 in the temperature changeover compartment 50 can be increased in depth to the positions adjacent to the heat insulating wall 46, making it possible to increase the storage capacity.

The arrangement in which the forced draft fan 62 is inclined obliquely at an upper rear portion of the cooling compartment 63 can further reduce the height of the cooling compartment 63, thus accommodating the cooling compartment 63 within only a rear region of the freezing compartment 52 and providing the same effects as above.

If the cooling compartment 63 in which the cooler 61 and the forced draft fan 62 are both accommodated does not fall within the height of the freezing compartment 52 (for example, if a desired cooling capacity of the whole refrigerator must be ensured by increasing the size of the cooler 61 and that of the forced draft fan 62, or if the capacity and height of the freezing compartment 52 must be reduced in consideration of those of other compartments), the forced draft fan 62 may be partially or entirely placed above a region positioned rearwardly of the freezing compartment 52. By so doing, the compressor 66, the cooler 61 and the forced draft fan 62 can be brought close to one another while ensuring an increase in inner volumetric efficiency caused by the side-by-side arrangement of the compressor 66 and the cooler 61, thereby enhancing the mounting efficiency.

In place of increasing the storage capacity, the height of the vegetable compartment may be reduced. Because the vegetable compartment becomes shallow and wide, the interior thereof can be easily seen and, hence, the piling up of vegetables is reduced, resulting in an easy-to-use vegetable compartment having a superior preserving ability.

Further, because it is not necessary to provide a space for accommodating the forced draft fan 62 at a rear portion of the vegetable compartment 49, the heat insulating partition wall 47 disposed above the freezing compartment 52 may not have a rising portion which has hitherto been formed therewith at a rear portion thereof, thus reducing the ineffectual volume and increasing the effective storage capacity.

An increase in depth of the storage compartments makes it possible to reduce the depth of the refrigerator body. A reduction in depth of the refrigerator body in turn prevents the refrigerator from protruding from a cupboard adjacent thereto, thus enhancing the indoor appearance.

Also, because the evaporating dish 68 is disposed immediately below the cooling compartment 63, the discharge pipe 65 is short, and the structure around it can be simplified. Further, the forced ventilating action of the compressor-cooling forced draft fan 69 causes warm air to flow over the surface of the water stored in the evaporating dish 68, thus promoting evaporation of the water produced by defrosting. Accordingly, the size of the evaporating dish 68 can be reduced. If the forced draft fan 69 is arranged to send air from the compressor 66 toward the evaporating dish 68, high-temperature heat from the compressor 66 can be utilized and, hence, evaporation of the water in the evaporating dish 68 is further promoted without providing an additional heating means, resulting in a reduction in size of the refrigerator.

Moreover, because the cover 70 for electric elements on the compressor 66 is directed to the open side of the machinery compartment 67, a space for attaching or removing the cover 70 is not required, making it possible to reduce the width of the machinery compartment 67. As a result, it becomes possible to increase the width of the cooling compartment 63 located beside the machinery compartment 67 and, hence, it is possible to increase the width of the cooler 61 and reduce the height thereof. Accordingly, the height of the cooling compartment 63 can be reduced, providing a compact structure and further increasing the effective volume.

Also, the thickness of the cooler 61 is smaller than that of the compressor 66 and, hence, the depth on the side of the cooling compartment 63 can be made smaller than that on the side of the compressor 66, thus creating the space 74 rearwardly of the cooling compartment 63. The dryer 72 and the condensation pipe 73 of the refrigerating cycle can be efficiently accommodated within this space 74 without violating the space inside the machinery compartment 67.

Further, the fixing members and the holding member for the dryer 72 and the condensation pipe 73 can be integrally formed with the machinery compartment panel 71, which forms a bottom portion and a lower rear portion of the refrigerator body 42, by molding the machinery compartment panel 71 from a resinous material. In addition, the external shell forming the relatively uneven machinery compartment 67 is not comprised of a plurality of component parts, but is of one-piece construction, making it possible to reduce the manufacturing cost of the refrigerator and improve the assembling workability.

(Embodiment 2)

Figure 4:
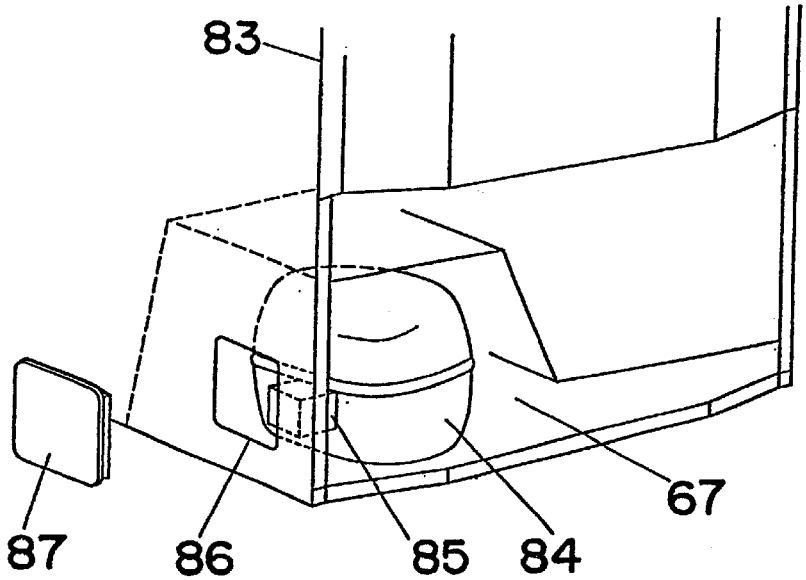
FIG. 4 is a perspective view, as viewed from behind, of the essential portion of a refrigerator according to a second embodiment of the present invention.

FIG. 4 is a perspective view, as viewed from behind, of an essential portion of a refrigerator according to a second embodiment of the present invention.

In FIG. 4, 83 denotes a refrigerator body, and 84 denotes a compressor placed within the machinery compartment 67. 85 denotes a cover for electric elements mounted on a side surface of the compressor 84. 86 denotes an opening defined in a portion of the refrigerator body forming a side wall of the machinery compartment 67, and 87 denotes a cover for covering the opening 86. The cover 87 is secured to the refrigerator body 83 by means of, for example, screws (not shown).

In the above-described construction, it is not necessary to provide a fist-sized space between the electric-element cover 85 and the side wall of the machinery compartment 67 for the purpose of attaching or removing the electric-element cover 85, and the attachment or removal of the electric-element cover 85 can be conducted from outside by removing the cover 87 from the side wall of the refrigerator body 83, making it possible to reduce the installation space in the widthwise direction of the compressor 84.

As a result, the width of the machinery compartment 67 can be reduced, while the width of the cooling compartment 63 and that of the cooler 61 can be increased. Accordingly, the height of the cooler 61 and that of the cooling compartment 63 can be reduced, providing a compact structure and further increasing the effective volume. Also, the electric-element cover 85 can be readily attached or removed from the side of the side wall of the refrigerator body 83, thus facilitating the maintenance of the finished goods.

(Embodiment 3)

Figure 5:
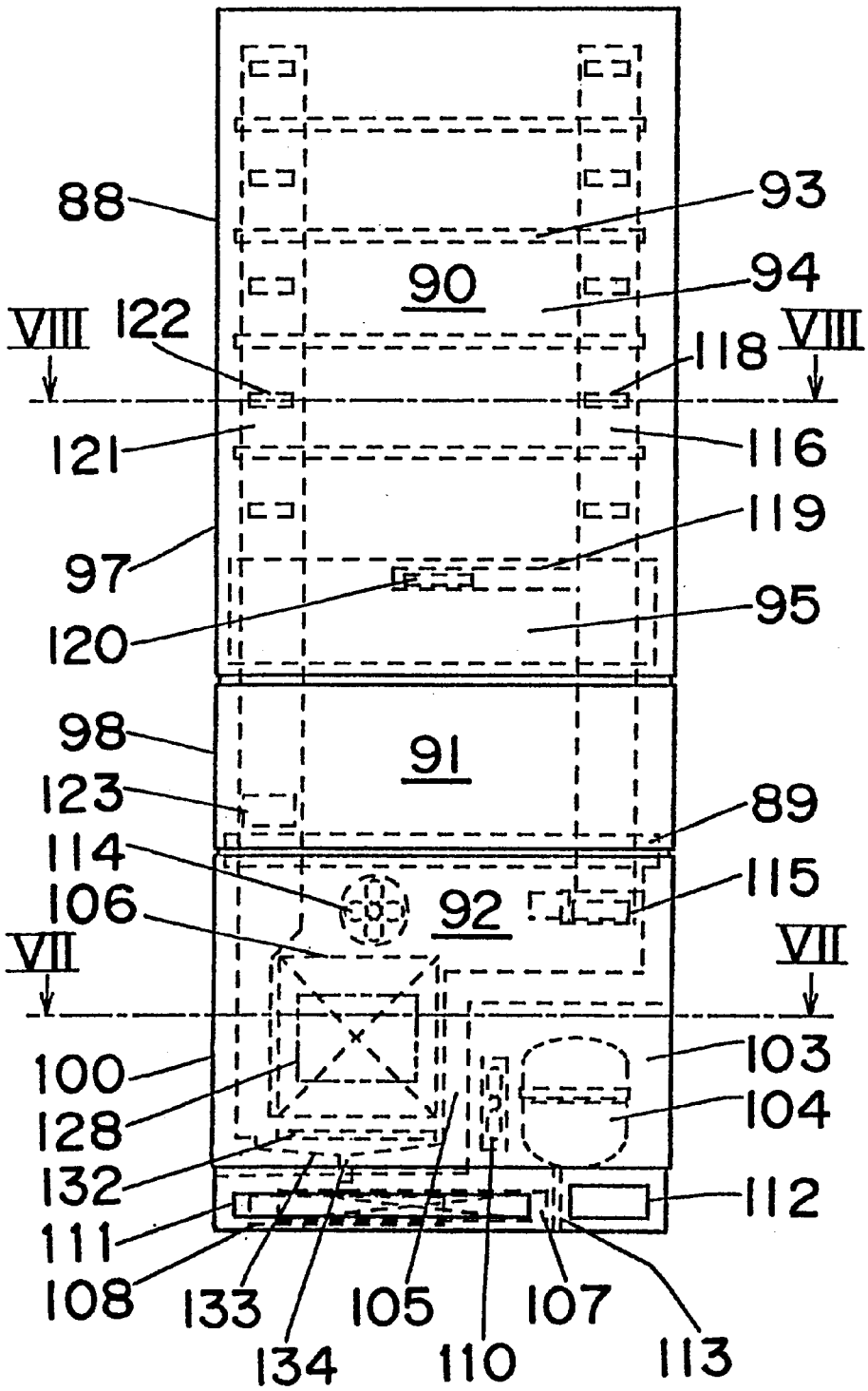
FIG. 5 is a front view of a refrigerator according to a third embodiment of the present invention.
Figure 6:
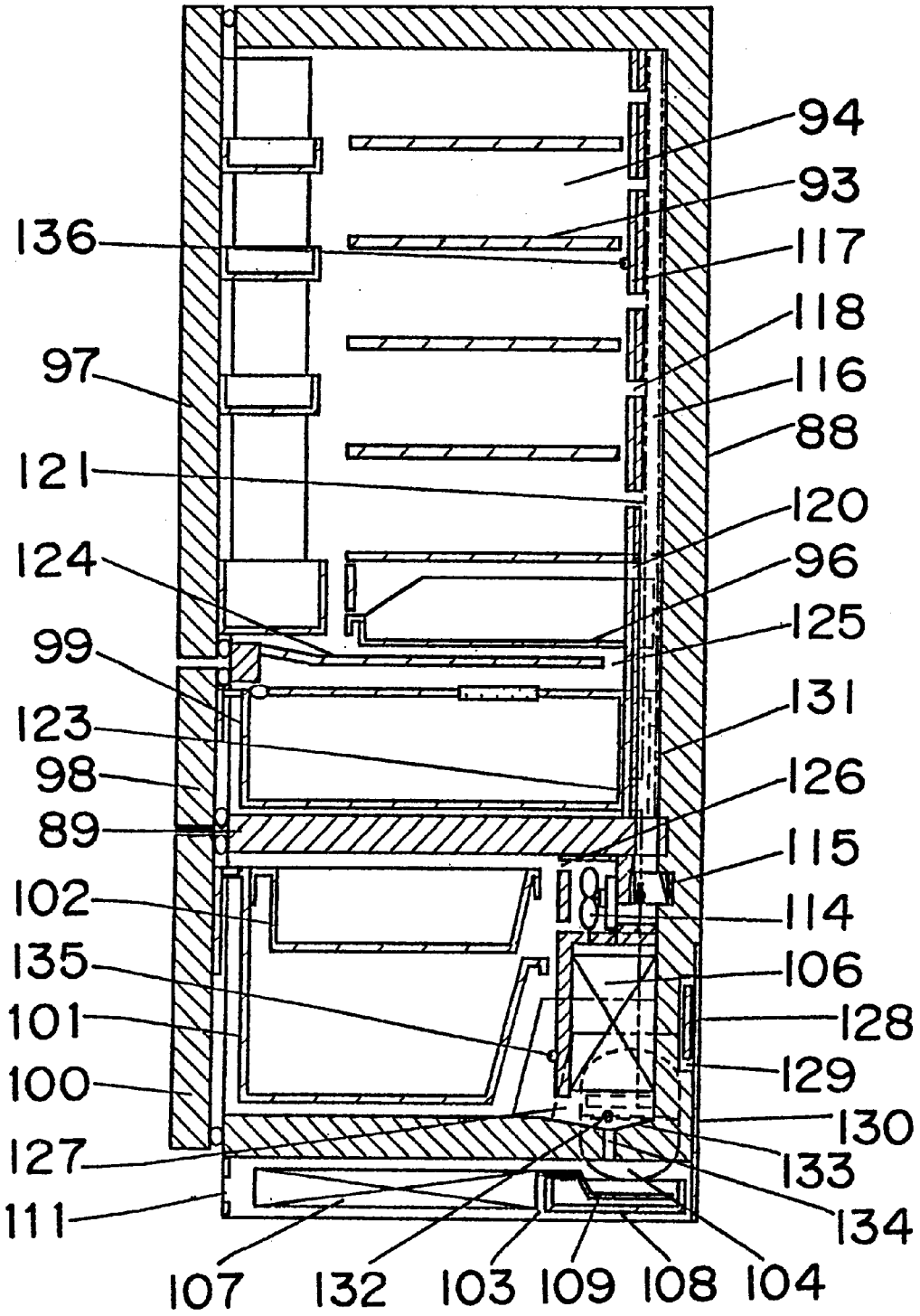
FIG. 6 is a vertical sectional view of the refrigerator of FIG. 5.
Figure 7:
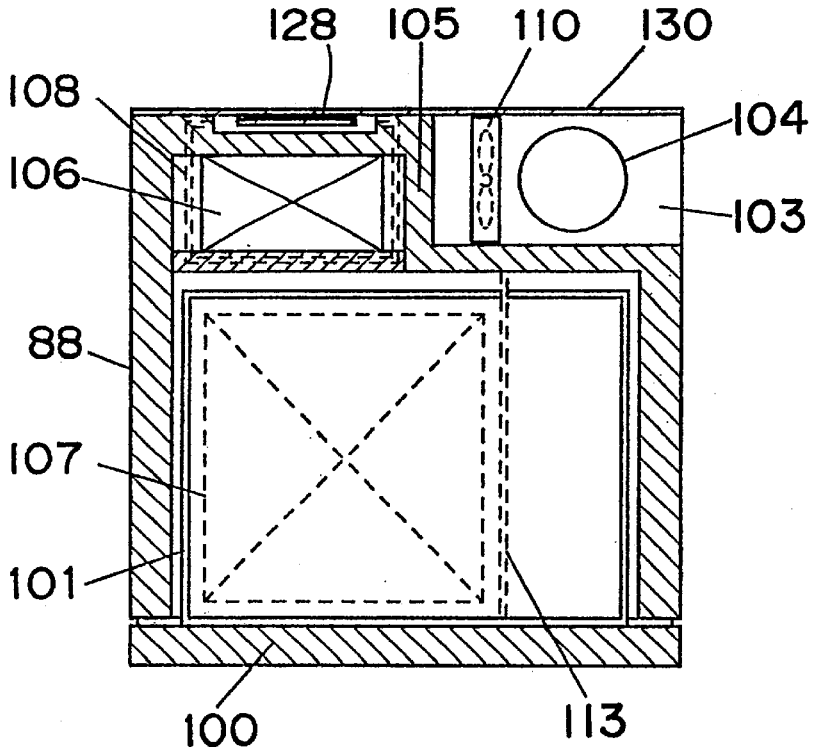
FIG. 7 is a sectional view taken along line VII—VII in FIG. 5.
Figure 8:
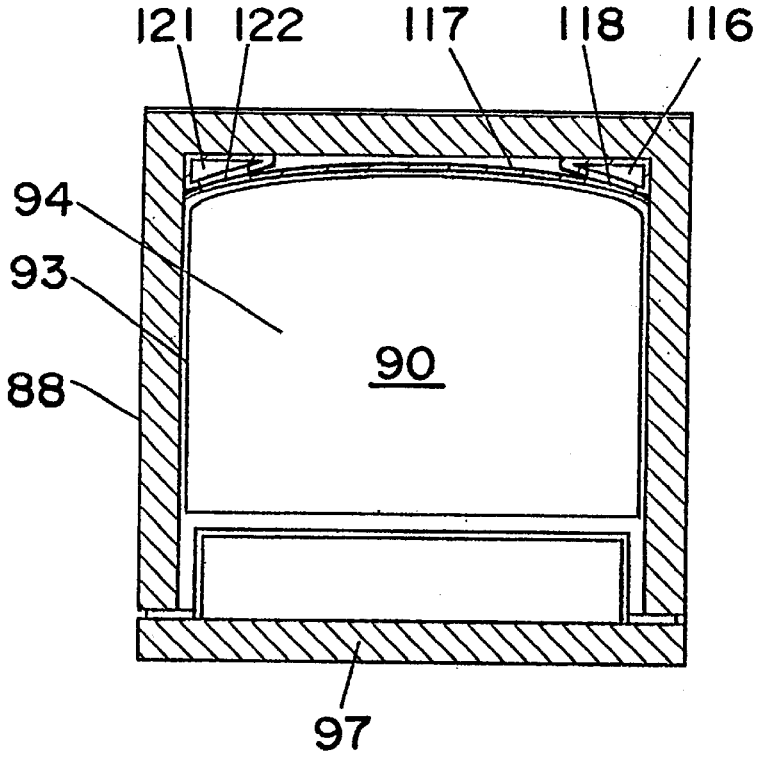
FIG. 8 is a sectional view taken along line VIII—VIII in FIG. 5.

FIG. 5 is a front view of a refrigerator according to a third embodiment of the present invention. FIG. 6 is a vertical sectional view of the refrigerator according to the same embodiment. FIG. 7 is a sectional view taken along line VII—VII in FIG. 5, while FIG. 8 is a sectional view taken along line VIII—VIII in FIG. 5.

In FIGS. 5 to 8, 88 denotes a refrigerator body. 89 denotes a heat insulating partition wall for partitioning the interior of the refrigerator body 88 into upper and lower chambers. The upper chamber includes a refrigerating compartment 90 and a vegetable compartment 91 formed below the refrigerating compartment 90, while the lower chamber includes a freezing compartment 92. 93 denotes a plurality of shelves disposed at appropriate intervals within the refrigerating compartment 90. A plurality of storage compartments 94 are formed between neighboring shelves 93. 95 denotes a low-temperature compartment formed within and at a lower portion of the refrigerating compartment 90 and accommodating a storage container 96 for preserving perishable foods such as meats, fishery products and the like at a temperature below the refrigerating temperature (for example, a chilling temperature of about 0° C., a partially freezing temperature of −3° C., etc.).

97 denotes a pivoted door for opening and closing an opening of the refrigerating compartment 90. 98 denotes a drawer-type door for opening and closing an opening of the vegetable compartment 91. The drawer-type door 98 can be drawn out together with a storage container 99 secured thereto and disposed within the cabinet. 100 denotes a drawer-type door for opening and closing an opening of the freezing compartment 92. The drawer-type door 100 can be drawn out together with a storage container 101 secured thereto and disposed within the cabinet. 102 denotes a second storage container disposed above the storage container 101 so as to be slidable back and forth.

103 denotes a machinery compartment formed at a lower rear portion of the refrigerator body 88 and accommodating a compressor 104 of a refrigerating cycle. The compressor 104 is juxtaposed with a cooler 106 accommodated within the cabinet in a side-by-side fashion with a heat insulating wall 105 interposed therebetween. Both the compressor and the cooler 106 are disposed rearwardly of the freezing compartment 92. Further, a condenser 107 is disposed below the freezing compartment 92.

A lower end surface of the cooler 106 is positioned lower than an upper end surface of the compressor 104 and, hence, the cooler 106 is disposed unevenly with respect to the compressor 104.

108 denotes an evaporating dish disposed below the cooler 106 for evaporating water produced by defrosting, and a condensation pipe 109 extending from the compressor 104 to the condenser 107 is submerged under water stored in the evaporating dish 108. 110 denotes a forced draft fan disposed within the machinery compartment 103 for promoting air convection to the compressor 104, the condenser 107, and the evaporating dish 108.

111 denotes an air suction port defined in a front wall of the machinery compartment 103 for sending air to the condenser 107, while 112 denotes an air discharge port defined in a front wall of the machinery compartment 103. An airway communicating with the air suction port 111 and an airway communicating with the air discharge port 112 are partitioned by a partition plate 113. The forced draft fan 110 takes in air through the air suction port 111 and sends it to the condenser 107, the evaporating dish 108, and the compressor 104 in this order before it is discharged from the air discharge port 112.

114 denotes a forced draft fan disposed above and adjacent to the cooler 106. 115 denotes a damper device juxtaposed with the forced draft fan 114 in a side-by-side fashion and disposed above the compressor 104 for controlling the amount of chilly air supplied to the refrigerating compartment 90, the vegetable compartment 91, and the low-temperature compartment 95. 116 denotes a chilly-air discharge duct for introducing chilly air from the damper device 115 to the refrigerating compartment 90 and the low-temperature compartment 95. The chilly-air discharge duct 116 is disposed within the cabinet at a rear or deep portion thereof so as to extend vertically on one side thereof. The chilly-air discharge duct 116 is covered with a rear ornamental plate 117 particularly in the refrigerating compartment 90, and has a plurality of chilly-air discharge ports 118 defined therein so as to be open to respective storage compartments 94. 119 denotes a branch duct branched from the chilly-air discharge duct 116 and leading to the low-temperature compartment 95, and 120 denotes a chilly-air discharge port formed in an end portion of the branch duct 119 so as to be open to the low-temperature compartment 95.

121 denotes a chilly-air suction duct for returning to the cooler 106 chilly air that has cooled the refrigerating compartment 90, the vegetable compartment 91, and the low-temperature compartment 95. The chilly-air suction duct 121 is disposed within the cabinet at a rear portion thereof so as to extend vertically on the other side thereof. The chilly-air suction duct 121 is covered with the rear ornamental plate 117 particularly in the refrigerating compartment 90, and has a plurality of chilly-air suction ports 122 defined therein so as to be open to respective storage compartments 94.

123 denotes a chilly-air suction port merging into the chilly-air suction duct 121 and being open to a rear portion of the vegetable compartment 91. 124 denotes a partition plate for partitioning the vegetable compartment 91 and the low-temperature compartment 95 from each other, and 125 denotes a communication port defined in the partition plate 124 at a rear portion thereof. 126 denotes a chilly-air discharge port formed in front of the forced draft fan 114 so as to communicate with the freezing compartment 92. 127 denotes a chilly-air suction port formed in a rear wall of the freezing compartment 92 at a lower portion thereof so as to communicate with a lower end portion of the cooler 106.

128 denotes a vertically extending electronic control board for controlling the operation of the electric component parts in the refrigerator. The electronic control board 128 is accommodated within a recess 129 positioned rearwardly of the cooler 106. 130 denotes a cover for covering the machinery compartment 103 and the electronic control board 128 from behind. The electronic control board 128 and the cooling functional elements such as the cooler 106, the forced draft fan 114, the damper device 115 and the like are collected together at a location rearwardly of the freezing compartment 92, while no cooling functional elements are disposed rearwardly of the vegetable compartment 91 and the low-temperature compartment 95 and, hence, respective storage containers 99, 96 confront a heat insulating wall 131 constituting the refrigerator body 88 at locations rearwardly thereof.

132 denotes a defrosting heater disposed below the cooler 106, and 133 denotes a drip pan for receiving water produced by defrosting with the use of the defrosting heater 132. 134 denotes a discharge pipe connected to the drip pan 133 for discharging the water in the drip pan 133 to the outside. The water discharged through the discharge pipe 134 is received by and stored in the evaporating dish 108 disposed within the machinery compartment and below the cooler 106.

135 denotes a temperature detector mounted on a rear wall of the freezing compartment 92 for detecting the temperature inside the freezing compartment. 136 denotes a temperature detector mounted on a rear wall of the refrigerating compartment 90 for detecting the temperature inside the refrigerating compartment.

The operation of the refrigerator of the above-described construction is explained hereinafter.

When the temperature detected by the temperature detector 135 within the freezing compartment is higher than a set value, the compressor 104 is operated, and chilly air cooled by the cooler 106 is caused to forcibly flow by the forced draft fan 114 and is discharged into the freezing compartment 92 via the chilly-air discharge port 126. Thereafter, the chilly air is returned to the cooler 106 via the chilly-air suction port 127. When the temperature detected by the temperature detector 135 becomes lower than the set value, the compressor 104 is stopped. Such operations are repeatedly carried out, and the interior of the freezing compartment is cooled to, for example, a freezing temperature of −18° C.

When the temperatures detected by the temperature detectors 135, 136 are higher than respective set values, the damper device 115 is opened, and the chilly air cooled by the cooler 106 is caused to forcibly flow by the forced draft fan 114 and is discharged into a side region of the refrigerating compartment 90 from the plurality of chilly-air discharge ports 118 via the chilly-air discharge duct 116 extending vertically in the proximity of one side rear portion of the refrigerating compartment 90. After the chilly air introduced into respective storage compartments 94 has cooled foods placed on the shelves 93, the chilly air enters the chilly-air suction duct 121, which extends vertically in the proximity of the other side rear portion of the refrigerating compartment 90, via the chilly-air suction ports 122 confronting respective storage compartments 94, before it returns to a lower portion of the cooler 106.

In this way, the foods placed on each shelf 93 in the refrigerating compartment 90 are uniformly cooled by a stream of chilly air flowing from on e side to the other side in each storage compartment 94, thus suppressing variations in temperature inside the refrigerating compartment and reducing uneven quality of the foods stored therein. Also, because the chilly-air discharge duct 116 and the chilly-air suction duct 121 are disposed on respective sides of a rear portion of the refrigerating compartment 90, a central space that is easy to use in storing foods is not violated, enhancing the storage capacity.

Further, in view of the external appearance, the chilly-air discharge and suction ducts are covered with the rear ornamental plate 117 in the refrigerating compartment. However, because no air ducts are disposed at a central portion, unlike the conventional refrigerators in which an inwardly protruding central portion deteriorates the appearance, the rear ornamental plate 117 can be so formed as to have a concave shape, enhancing the value in design. Also, an ineffectual volume that has been hitherto created by the central air duct can be reduced, resulting in a increase in storage capacity.

The chilly air entering the chilly-air suction duct 121 flows downwardly, returns to the lower portion of the cooler 106, and is cooled again by the cooler 106, while part of the chilly air that has cooled the interior of the refrigerating compartment 90 enters an upper portion of the vegetable compartment 91 from a communication port formed in a rear portion of the partition plate 124 without being drawn into the chilly-air suction duct 121. Such chilly air flows around the storage container 99 and indirectly cools foods in the storage container 99. Accordingly, it is possible to preserve perishables such as vegetables, fruits and the like while restraining them from drying. The chilly air after convection enters the chilly-air suction duct 121 through the chilly-air suction port 123 in the rear wall of the vegetable compartment 91 and returns to the cooler 106.

On the other hand, part of the chilly air entering the damper de vice 115 is distributed to the branch duct 119 and sent to the low-temperature compartment 95 from the chilly-air discharge port 120. This chilly air cools the interior of the low-temperature compartment 95 to a temperature lower than that in the refrigerating compartment 90 so that perishables such as fishery products, meats and the like may be preserved at a low temperature. The chilly air that has cooled the low-temperature compartment 95 enters the vegetable compartment 91 through the communication port 125.

When the temperature detected by the temperature detector 136 becomes lower than the set temperature, the damper device 115 is closed, and the above operations are repeatedly carried out. As a result, the interior of the refrigerating compartment 90 is cooled to and maintained at a desired temperature of, for example, 4° C. suited for cold storage, that of the vegetable compartment 91 at a desired temperature of, for example, 6° C. suited for both vegetables and fruits, and that of the low-temperature compartment 95 at a desired chilling temperature of, for example, 0° C.

In regard to the arrangement of the refrigerating cycle, the compressor 104 is off to the side from the vertical centerline of the refrigerator body 88. As a result of reducing the ineffectual space within the machinery compartment 1O3, the width of the machinery compartment 103 is reduced to half the width of the refrigerator body 88. In consideration of the depth and height with which the cooling capacity is maintained, the cooler 106 is accommodated within the space newly created on the inner side of the refrigerator body by reducing the ineffectual space.

As a result, the compressor 104 and the cooler 106 are disposed in a side-by-side fashion with the heat insulating wall 105 interposed therebetween. This arrangement makes it possible to minimize an ineffectual space in the widthwise direction of the refrigerator, which space has hitherto been created by placing the cooler 106 above the compressor 104, thus increasing the effective storage capacity.

With the side-by-side arrangement of the compressor 104 and the cooler 106, both of which are heavy, the center of gravity of the refrigerator body 88 becomes lower than that of the conventional one, enhancing the stability.

Further, because the damper device 115 is provided by making good use of that space within the cabinet which is positioned above the compressor 104 and laterally of the forced draft fan 114 disposed above the cooler 106, all the cooler 106, the forced draft fan 114, and the damper device 115 are efficiently placed rearwardly of the freezing compartment 92 positioned at a lowermost portion of the refrigerator body 88, thus enhancing the mounting efficiency. Because of this, a new space for accommodating the damper device 115 is not required, unlike the conventional refrigerator, resulting in an increase in storage volume.

Also, the arrangement in which the freezing compartment 92 and the cooler 106 are disposed adjacent to each other enhances the cooling efficiency. In regard to the refrigerating compartment other than the freezing compartment, the forced draft fan 114 and the damper device 115 are disposed adjacent to the cooler 106, and the chilly-air discharge duct 116 extends immediately upwardly from the damper device 115 to reduce the resistance to flow, resulting in an increase in cooling efficiency.

Moreover, although the forced draft fan 114 is disposed above the cooler 106, the former does not violate a rear space of the vegetable compartment 91. Accordingly, the storage container 99 in the vegetable compartment 91 can be extended to a position confronting the rear heat insulating wall 131, making it possible to increase the storage capacity. In place of increasing the storage capacity, the height of the vegetable compartment can be reduced. Because the vegetable compartment becomes shallow and wide, the interior thereof can be easily seen and, hence, the piling up of vegetables is reduced, resulting in an easy-to-use vegetable compartment having a superior preserving ability.

In addition, because it is not necessary to provide a space for accommodating the forced draft fan 114 at a position rearwardly of the vegetable compartment 91, the heat insulating partition wall 89 interposed between the vegetable compartment 91 and the freezing compartment 92 may not have a rising portion at a rear portion thereof, unlike the conventional refrigerator, thus reducing an ineffectual volume and increasing the storage capacity.

Also, because it is not necessary to arrange the damper device 115 behind the low-temperature compartment 95 or the refrigerating compartment 90, a lower region of the refrigerating compartment which is easy to use in terms of level can be utilized to a deep portion as a storage portion, making it possible to realize an easy-to-use refrigerator.

The interior of the machinery compartment 103 is discussed hereinafter. As shown in FIG. 7, the operation of the forced draft fan 110 introduces air into the machinery compartment 103 through the air suction port 111 in a front wall of a bottom portion of the refrigerator body 88, and the air thus introduced exchanges heat with the condenser 107 to promote heat radiation therefrom and then flows above the evaporating dish 108. Water produced by defrosting and stored in the evaporating dish 108 is heated by a direct heating action of the condensation pipe 109 submerged under water and is also heated and well-ventilated by forced convection of warm air heat-exchanged with the condenser 107, resulting in an efficient evaporation. Having passed the evaporating dish 108, the air cools an external shell of the compressor 104 having a higher temperature and is then discharged forwardly of the refrigerator body 88 through the air discharge port 112. A frost that has adhered to the cooler 106 during cooling is melted by the defrosting heater 132 and is received by the dip pan 133 before it reaches the evaporating dish 108 through the discharge pipe 134. However, because the cooler 106 is disposed above and adjacent to the evaporating dish 108, the discharge pipe 134 can be shortened, making it possible to simplify the structure.

As described above, the condenser 107 and the evaporating dish 108 can be efficiently accommodated by making good use of a space at a bottom portion of the refrigerator body 88. While maintaining the condensing ability of the condenser 107, the evaporating ability of the evaporating dish 108, and the efficiency and reliability of the compressor 104 by circulating cooled air within the machinery compartment 103 using the force draft fan 110, the machinery compartment can be made compact, making it possible to increase the storage space within the cabinet.

Further, because the electronic control board 128 for driving and controlling electric component parts is accommodated within a recess in an external surface positioned rearwardly of the cooler 106, the electronic control board 128 is positioned close to the electric component parts such as the compressor 104, the forced draft fans 110, 114, the damper device 115, the defrosting heater 132, and the like, making it possible to shorten and simplify electric wires, reduce the cost, and enhance the workability. Also, complicated wiring is reduced, thus reducing the influence of radio noise disorder, for example.

From the viewpoint of the mounting efficiency of the cooling functional elements and the control elements, because almost all of them are collectively disposed rearwardly of and below the freezing compartment 92, the refrigerator can be designed compact with a very high mounting efficiency. Because of this, not only can pipes in the refrigerating cycle be shortened but the piping arrangement can also be simplified, making it possible to reduce the cost and enhance the assembling workability. In addition, if such elements are assembled into a block structure in advance, which is in turn incorporated into the refrigerator body 88, the working processes can be remarkably simplified. Also, the block structure is easy to cope with the common use or standardization of the component parts, making it possible to further reduce the cost and rationalize the production line.

The volume created by enhancing the mounting efficiency of the cooling functional elements and the control elements can be directly utilized to increase the storage volume or reduce the external size of the refrigerator body 88 for a reduction in installation space. In that case, the length by which the refrigerator protrudes forwardly from a cupboard or the like can be reduced by reducing the depth of the refrigerator, or the interior of a kitchen can be improved in conformity with the standards for systematic kitchens.

Alternatively, the increased volume can be used for a heat insulating volume. Energy saving can be achieved or the size of the component parts of the refrigerating cycle such as the compressor 104 and the like can be reduced by reducing the amount of heat absorption of the refrigerator, resulting in a reduction in cost.

(Embodiment 4)

Figure 9:
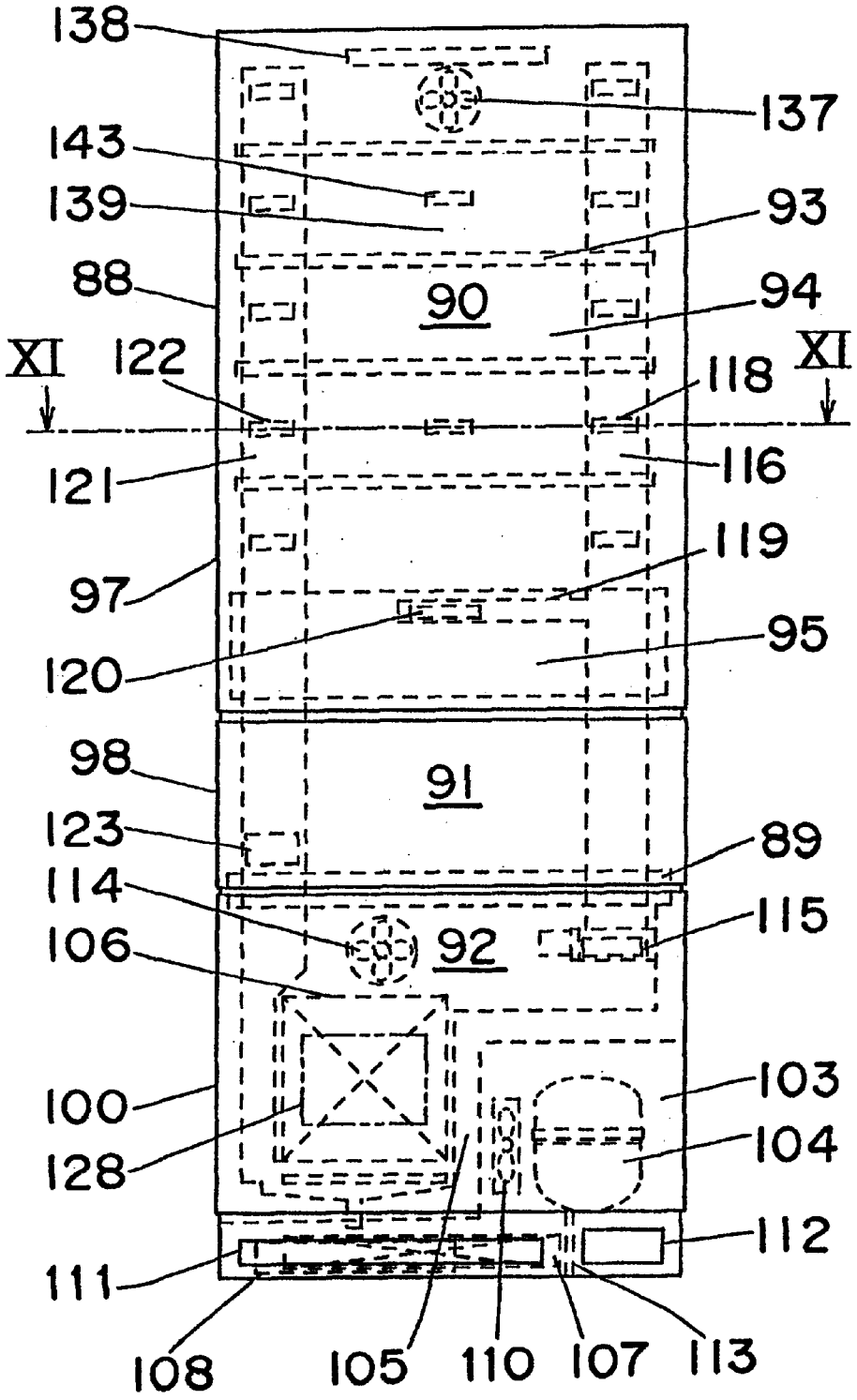
FIG. 9 is a front view of a refrigerator according to a fourth embodiment of the present invention.
Figure 10:
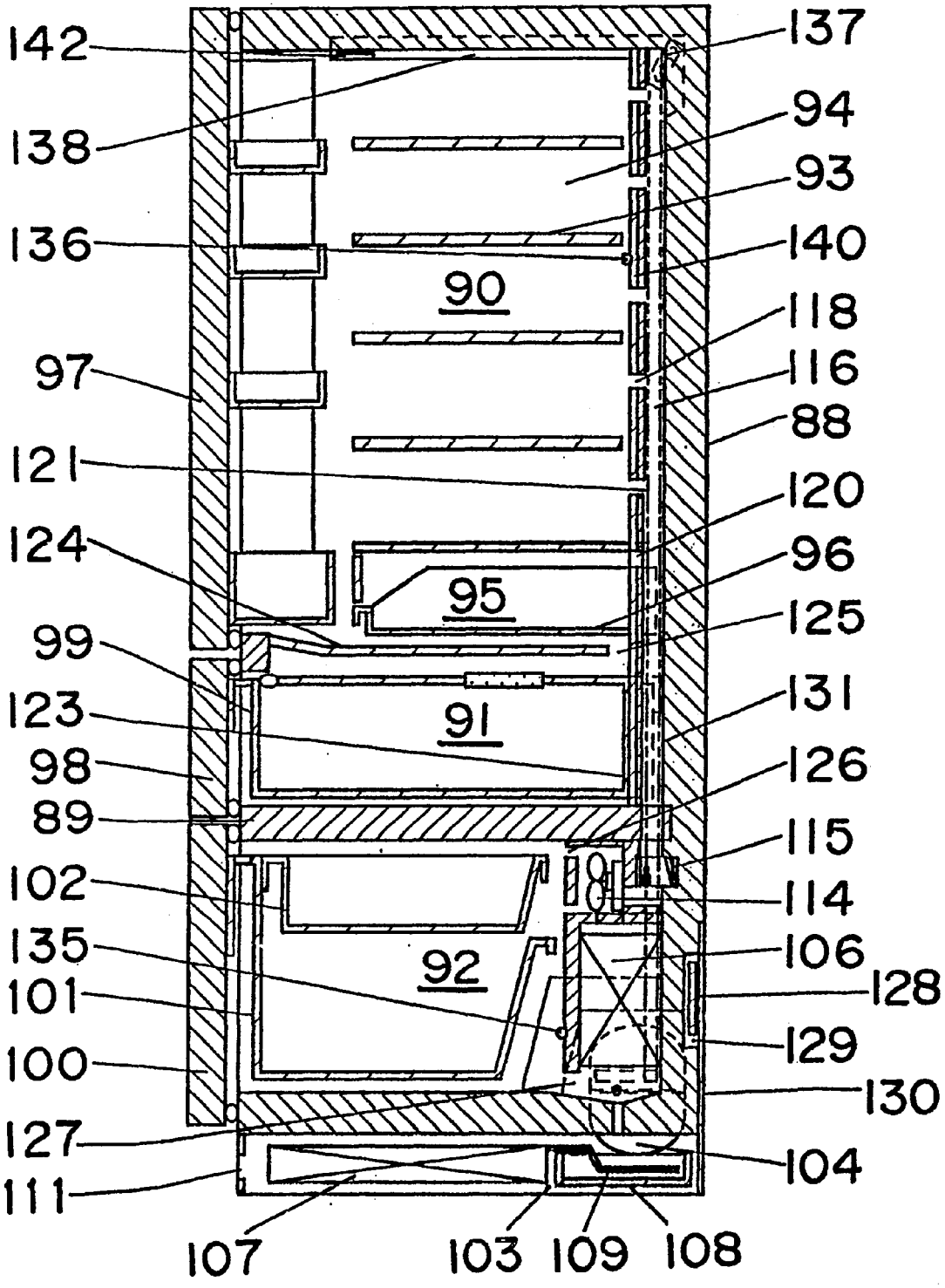
FIG. 10 is a vertical sectional view of the refrigerator of FIG. 9.
Figure 11:
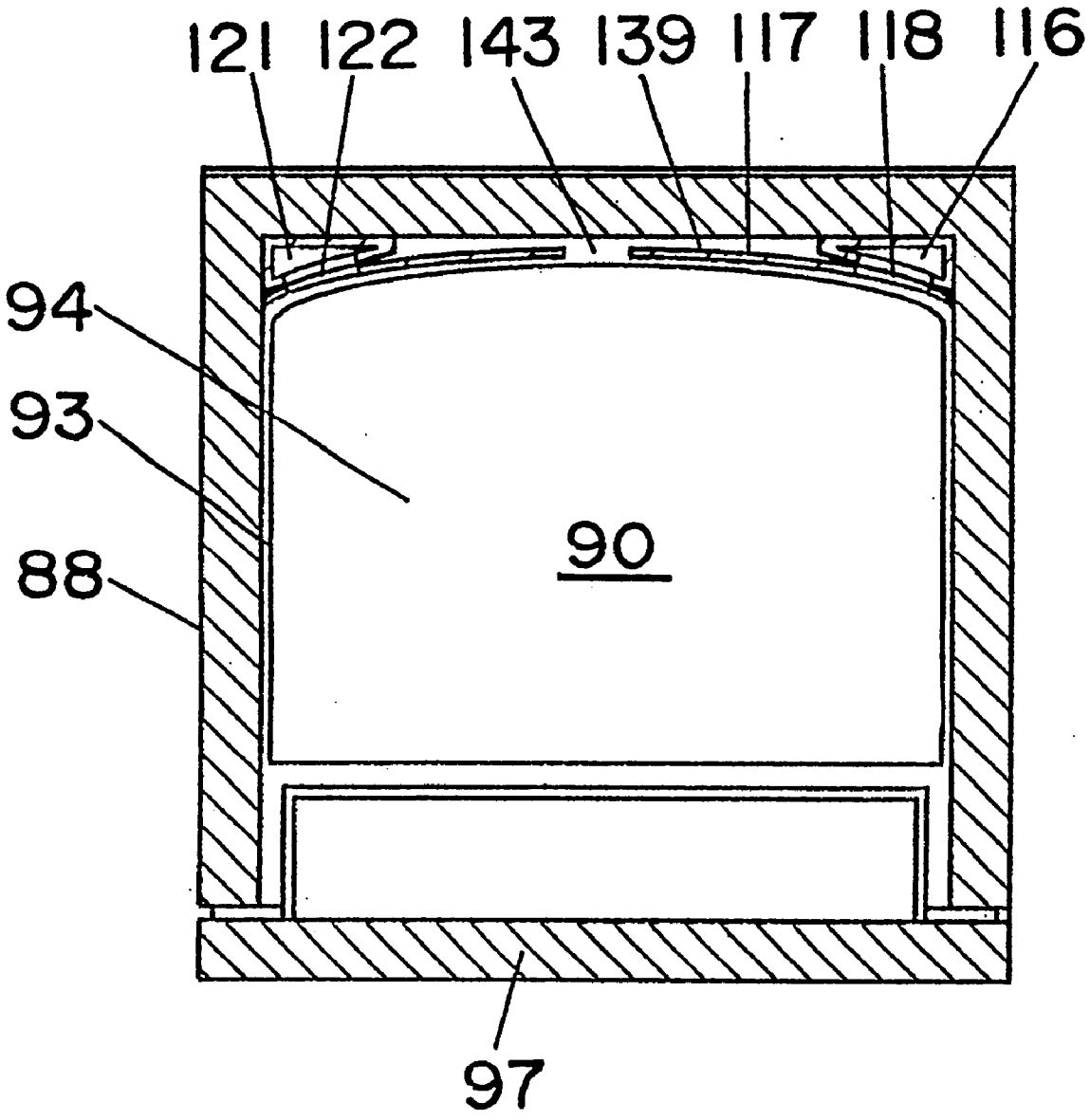
FIG. 11 is a sectional view taken along line XI—XI in FIG. 9.

FIG. 9 is a front view of a refrigerator according to a fourth embodiment of the present invention. FIG. 10 is a vertical sectional view of the refrigerator according to the same embodiment. FIG. 11 is a sectional view taken along line XI—XI in FIG. 9.

In FIGS. 9 to 11, 137 denotes a forced draft fan disposed at an upper rear portion of the refrigerating compartment 90 for circulating air. 138 denotes an air discharge duct mounted on a top wall of the refrigerating compartment 90 so as to communicate with the discharge side of the forced draft fan 137. 139 denotes an air suction duct formed at a central portion behind a rear ornamental plate 140 so as to communicate with the suction side of the forced draft fan 137. 142 denotes an air discharge port defined in a front portion of the air discharge duct 138, and 143 denotes an air suction port defined in the rear ornamental plate 140 so as to communicated with the air suction duct 139 at an appropriate portion of the refrigerating compartment 90.

The air circulating forced draft fan 137 is operated for a predetermined period of time when the damper device 115 is opened and after the door 97 of the refrigerating compartment has been closed.

The operation of the refrigerator of the above-described construction is explained hereinafter.

When the temperatures detected by the temperature detectors 135, 136 are higher than respective set values, the damper device 115 is opened, and the chilly air cooled by the cooler 106 is caused to forcibly flow by the forced draft fan 114 and is discharged into a side region of the refrigerating compartment 90 from the plurality of chilly-air discharge ports 118 via the chilly-air discharge duct 116 extending vertically in the proximity of a side rear portion of the refrigerating compartment 90. After the chilly air introduced into respective storage compartments 94 has cooled foods placed on the shelves 93, the chilly air enters the chilly-air suction duct 121, which extends vertically in the proximity of the other side rear portion of the refrigerating compartment 90, via the chilly-air suction ports 122 confronting respective storage compartments 94, before it returns to a lower portion of the cooler 106.

At the same time, the air circulating forced draft fan 137 is operated so that the air inside the refrigerating compartment 90 may be introduced into the air suction duct 139 through the air suction port 143. The air is then discharged into an upper front portion of the refrigerating compartment from the air discharge port 142 through the air discharge duct 138 on the top wall. The forced circulation of the air inside the refrigerating compartment 90 promotes convection and further reduces uneven cooling. In particular, low-temperature air that is apt to stay at a lower portion of the refrigerating compartment 90 is sucked up and circulated towards a rear region of the door 97 and an upper region of the refrigerating compartment 90 where the cooled air is hard to reach and, hence, the temperature is apt to become high.

Even if the temperature inside the refrigerating compartment 90 rises due to an air exchange with the open air caused by opening the door 97 the air circulating forced draft fan 137 is operated for the predetermined period of time after the door 97 has been closed to promote the cooling of the interior of the refrigerating compartment, making it possible to suppress a temperature rise inside the refrigerating compartment 90.

In addition to the above-described control method, the air circulating forced draft fan 137 may be controlled such that it may be operated intermittently at appropriate time intervals, even if the damper device 115 is closed, to compensate for a temperature rise that may occur at an upper portion of the refrigerating compartment during the closure of the damper device, or it may be operated, even when the door 97 is opened, to flow air from the front portion of the top wall, like an air curtain, to prevent entry of the external air.

In this way, the foods stored within the refrigerating compartment 90 are uniformly cooled by a stream of chilly air flowing from one side to the other side in each storage compartment 94. At the same time, temperature variations inside the refrigerating compartment are further suppressed by the circulating action of the air circulating forced draft fan 137. As a result, the quality of foods is stabilized, making it possible to realize a refrigerator being superior in the preserving ability.

(Embodiment 5)

Figure 12:
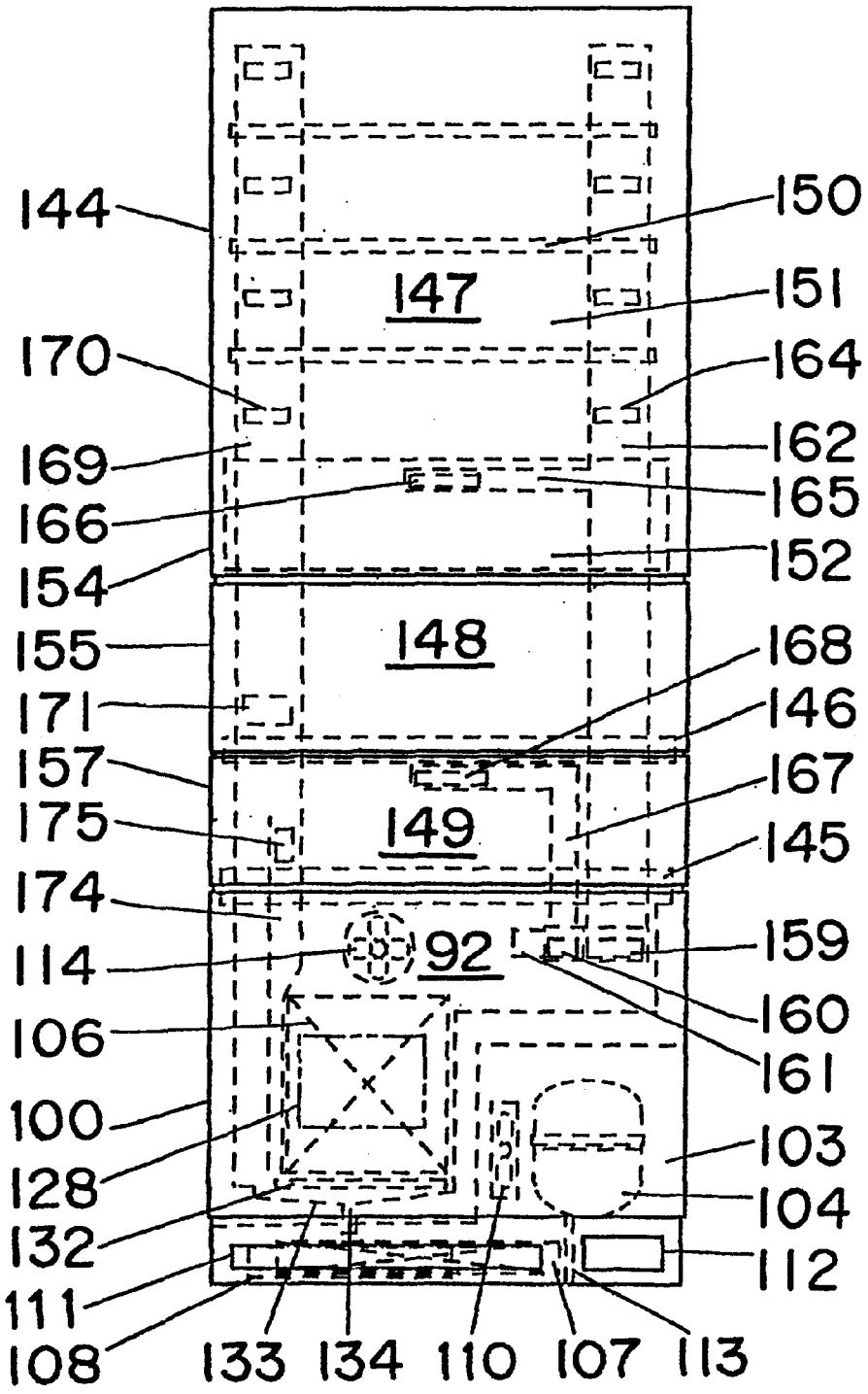
FIG. 12 is a front view of a refrigerator according to a fifth embodiment of the present invention.
Figure 13:
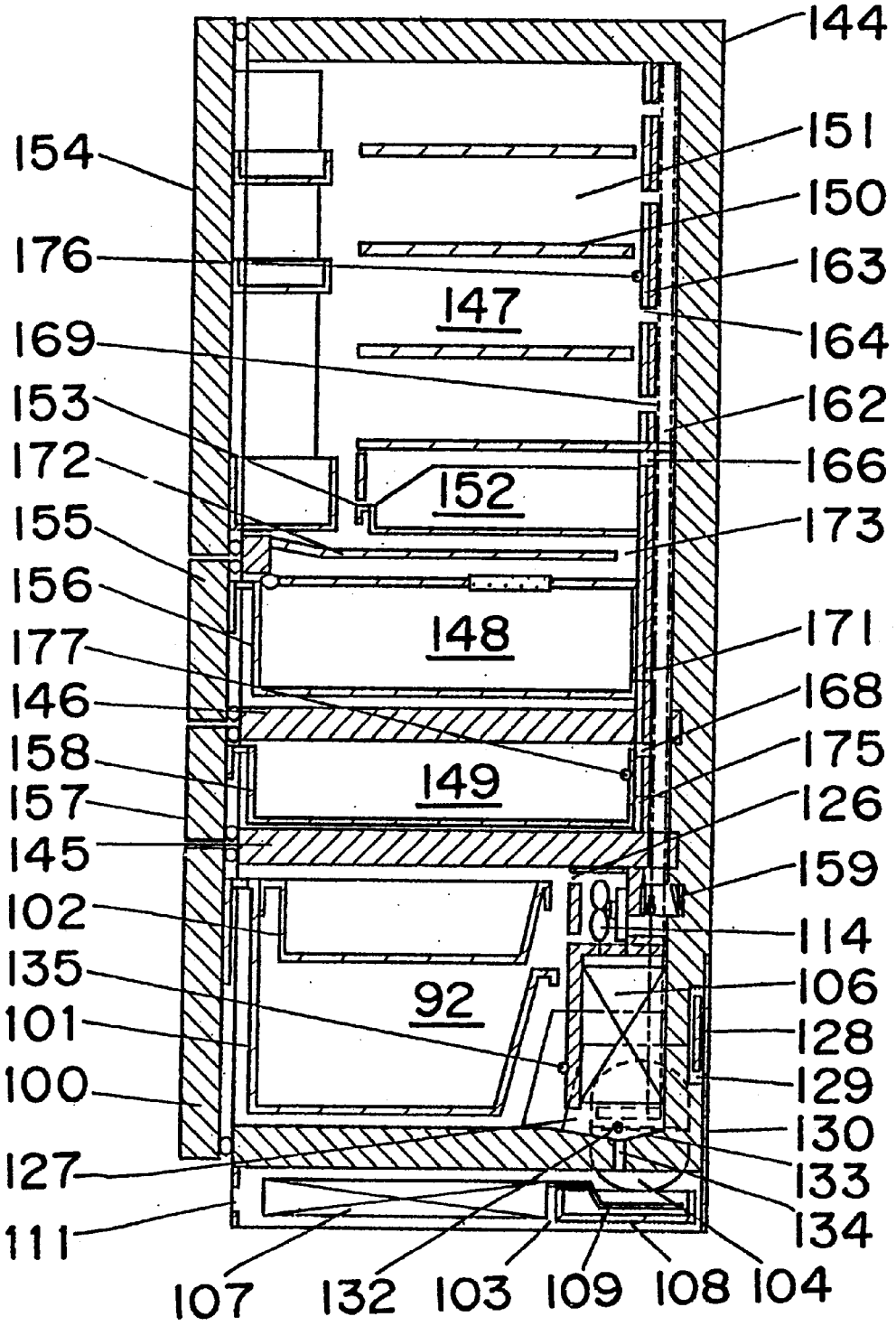
FIG. 13 is a vertical sectional view of the refrigerator of FIG. 12.

FIG. 12 is a front view of a refrigerator according to a fifth embodiment of the present invention. FIG. 13 is a vertical sectional view of the refrigerator according to the same embodiment.

In FIGS. 12 and 13, 144 denotes a refrigerator body. 145 denotes a heat insulating partition wall for partitioning the interior of the refrigerator body 144 into upper and lower chambers. 146 denotes a second heat insulating partition wall. A freezing compartment 92 is formed below the heat insulating partition wall 145, while a refrigerating compartment 147 and a vegetable compartment 148 provided below the refrigerating compartment 147 are formed above the second heat insulating partition wall 146. A multipurpose compartment 149 is formed between the heat insulating partition wall 145 and the second heat insulating partition wall 146. The multipurpose compartment 149 is designed such that the internal temperature can be switched to a desired one in a temperature zone allowing both the refrigerating and the freezing depending on uses of the user.

150 denotes a plurality of shelves disposed at appropriate intervals within the refrigerating compartment 147. A plurality of storage compartments 151 are formed between neighboring shelves 150. 152 denotes a low-temperature compartment formed within and at a lower portion of the refrigerating compartment 147 and accommodating a storage container 153 for preserving perishable foods such as meats, fishery products and the like at a temperature below the refrigerating temperature (for example, a chilling temperature of about 0° C., a partially freezing temperature of −3° C., etc.).

154 denotes a pivoted door for opening and closing an opening of the refrigerating compartment 147. 155 denotes a drawer-type door for opening and closing an opening of the vegetable compartment 148. The drawer-type door 155 can be drawn out together with a storage container 156 secured thereto and disposed within the cabinet. 157 denotes a drawer-type door for opening and closing an opening of the multipurpose compartment 149. The drawer-type door 157 can be drawn out together with a storage container 158 secured thereto and disposed within the cabinet.

159 and 160 denote a damper device and a second damper device, both juxtaposed with the forced draft fan 114 in a side-by-side fashion and disposed above the compressor 104. Both the damper devices 159, 160 are driven by a single electric motor 161. The damper device 159 controls the amount of chilly air supplied to the refrigerating compartment 147, the vegetable compartment 148 and the low-temperature compartment 152, while the second damper device 160 controls the amount of chilly air supplied to the multipurpose compartment 149.

162 denotes a chilly-air discharge duct for introducing chilly air from the damper device 159 to the refrigerating compartment 147 and the low-temperature compartment 152. The chilly-air discharge duct 162 is disposed within the cabinet at a rear portion thereof so as to extend vertically on one side thereof. The chilly-air discharge duct 162 is covered with a rear ornamental plate 163 particularly in the refrigerating compartment 147, and has a plurality of chilly-air discharge ports 164 defined therein so as to be open to respective storage compartments 151. 165 denotes a branch duct branched from the chilly-air discharge duct 162 and leading to the low-temperature compartment 152, and 166 denotes a chilly-air discharge port formed in an end portion of the branch duct 165 so as to be open to the low-temperature compartment 152.

167 denotes a second chilly-air discharge duct for introducing chilly air from the second damper device 160 to the multipurpose compartment 149, while 168 denotes a chilly-air discharge port formed in an end portion of the chilly-air discharge duct 167 so as to be open to the multipurpose compartment 149.

169 denotes a chilly-air suction duct for returning to the cooler 106 chilly air that has cooled the refrigerating compartment 147, the vegetable compartment 148, and the low-temperature compartment 152. The chilly-air suction duct 169 is disposed within the cabinet at a rear portion thereof so as to extend vertically on the other side thereof. The chilly-air suction duct 169 is covered with the rear ornamental plate 163 particularly in the refrigerating compartment 147, and has a plurality of chilly-air suction ports 170 defined therein so as to be open to respective storage compartments 151.

171 denotes a chilly-air suction port merging into the chilly-air suction duct 169 and being open to a rear portion of the vegetable compartment 148. 172 denotes a partition plate for partitioning the vegetable compartment 148 and the low-temperature compartment 152 from each other, and 173 denotes a communication port defined in the partition plate 172 at a rear portion thereof. 174 denotes a second chilly-air suction duct for returning to the cooler 106 chilly air that has cooled the multipurpose compartment 149, and 175 denotes a chilly-air suction port being open to a rear portion of the multipurpose compartment 149 and communicating with the second chilly-air suction duct 174.

The electronic control board 128 employed as a cooling control element and the cooling functional elements such as the cooler 106, the forced draft fan 114, the damper device 159, the second damper device 160 and the like are collected together at a location rearwardly of the freezing compartment 92, while no cooling functional elements are disposed rearwardly of the vegetable compartment 148, the multipurpose compartment 149, and the low-temperature compartment 152 and, hence, respective storage containers 156, 158, 153 confront an inner wall of the refrigerator body 144 at locations rearwardly thereof.

176 denotes a temperature detector mounted on a rear wall of the refrigerating compartment 147 for detecting the temperature inside the refrigerating compartment, while 177 denotes a temperature detector mounted on a rear wall of the multipurpose compartment 149 for detecting the temperature inside the multipurpose compartment.

The operation of the refrigerator having the above-described construction is explained hereinafter.

When the temperature detected by the temperature detector 135 within the freezing compartment is higher than a set value, the compressor 104 is operated, and chilly air cooled by the cooler 106 is caused to forcibly flow by the forced draft fan 114 and is discharged into the freezing compartment 92 via the chilly-air discharge port 126. Thereafter, the chilly air is returned to the cooler 106 via the chilly-air suction port 127. When the temperature detected by the temperature detector 135 becomes lower than the set value, the compressor 104 is stopped. Such operations are repeatedly carried out, and the interior of the freezing compartment is cooled to, for example, a freezing temperature of −18° C.

When the temperatures detected by the temperature detectors 135, 176 are higher than respective set values, the damper device 159 is opened, and the chilly air cooled by the cooler 106 is caused to forcibly flow by the forced draft fan 114 and is discharged into a side region of the refrigerating compartment 147 from the plurality of chilly-air discharge ports 164 via the chilly-air discharge duct 162 extending vertically in the proximity of one side rear portion of the refrigerating compartment 147. After the chilly air introduced into respective storage compartments 151 has cooled foods placed on the shelves 150, the chilly air enters the chilly-air suction duct 169, which extends vertically in the proximity of the other side rear portion of the refrigerating compartment 147, via the chilly-air suction ports 170 confronting respective storage compartments 151, before it returns to a lower portion of the cooler 106.

In this way, the foods placed on each shelf 150 in the refrigerating compartment 147 are uniformly cooled by a stream of chilly air flowing from one side to the other side in each storage compartment 151, thus suppressing variations in temperature inside the refrigerating compartment and reducing uneven quality of the foods stored therein. Also, because the chilly-air discharge duct 162 and the chilly-air suction duct 169 are disposed on respective sides of a rear portion of the refrigerating compartment 147, a central space that is easy to use in storing foods is not violated, enhancing the storage capacity.

Further, in view of the external appearance, the chilly-air discharge and suction ducts are covered with the rear ornamental plate 163 in the refrigerating compartment. However, because no air ducts are disposed at a central portion, unlike the conventional refrigerators in which an inwardly protruding central portion deteriorates the appearance, the rear ornamental plate 163 can be so formed as to have a concave shape, enhancing the value in design. Also, an ineffectual volume that has been hitherto created by the central air duct can be reduced, resulting in a increase in storage capacity.

The chilly air entering the chilly-air suction duct 169 flows downwardly, returns to the lower portion of the cooler 106, and is cooled again by the cooler 106, while part of the chilly air that has cooled the interior of the refrigerating compartment 147 enters an upper portion of the vegetable compartment 148 from a communication port 173 formed in a rear portion of the partition plate 172 without being drawn into the chilly-air suction duct 169. Such chilly air flows around the storage container 156 and indirectly cools foods in the storage container 156. Accordingly, it is possible to preserve perishables such as vegetables, fruits and the like while restraining them from drying. The chilly air after convection enters the chilly-air suction duct 169 through the chilly-air suction port 171 in the rear wall of the vegetable compartment 148 and returns to the cooler 106.

On the other hand, part of the chilly air flowing through the chilly-air discharge duct 162 is distributed to the branch duct 165 and sent to the low-temperature compartment 152 from the chilly-air discharge port 166. This chilly air cools the interior of the low-temperature compartment 152 to a temperature lower than that in the refrigerating compartment 147 so that perishables such as fishery products, meats and the like may be preserved at a low temperature. The chilly air that has cooled the low-temperature compartment 152 enters the vegetable compartment 148 through the communication port 173.

When the temperature detected by the temperature detector 176 becomes lower than the set temperature, the damper device 159 is closed, and the above operations are repeatedly carried out. As a result, the interior of the refrigerating compartment 147 is cooled to and maintained at a desired temperature of, for example, 4° C. suited for cold storage, that of the vegetable compartment 148 at a desired temperature of, for example, 6° C. suited for both vegetables and fruits, and that of the low-temperature compartment 152 at a desired chilling temperature of, for example, 0° C.

When the temperatures detected by the temperature detectors 135, 177 are higher than respective set values, the second damper device 160 is opened, and the chilly air cooled by the cooler 106 is caused to forcibly flow by the forced draft fan 114 and sent to the multipurpose compartment 149 from the chilly-air discharge port 168 via the second chilly-air discharge duct 167. The chilly air that has cooled the multipurpose compartment 149 enters the second chilly-air suction duct 174 from the chilly-air suction port 175 and is returned to the cooler 106.

Because the temperature inside the multipurpose compartment 149 can be optionally switched depending on the user's convenience or liking, the degree of opening of the second damper device 160 changes according to the user's selection, making it possible to maintain the interior of the multipurpose compartment 152 in a desired temperature zone. Further, because the multipurpose compartment 149 is interposed between the heat insulating partition wall 145 and the second heat insulating partition wall 146 and is, hence, insulated from the vegetable compartment 148 positioned above it and the freezing compartment 92 positioned below it, the temperature inside it can be switched in a wide temperature range covering both the refrigerating temperature zone and the freezing temperature zone, and can be set to a refrigerating temperature of 4° C., a chilling temperature of 0° C., a freezing temperature of −18° C., or the like. Thus, the degree of freedom in storing foods is increased and, hence, the refrigerator capable of absorbing variations in foods depending on seasonal variation can be provided.

When the temperature detected by the temperature detector 177 becomes lower than the set value, the second damper device 160 is closed. This operation is repeatedly carried out, and the interior of the multipurpose compartment 149 is cooled to and maintained at a desired temperature.

The multipurpose compartment 149 is provided with a drawer-type door 157, with which a storage container 156 can be easily drawn out at a level that is easy to take foods in and out. That is, because the multipurpose compartment 149 is positioned between the vegetable compartment 148 and the freezing compartment 92 at a level slightly lower than the center of the refrigerator body 144, it is easy to use. In addition, the storage container 156 is appropriately shallow and easy to put foods in order. Accordingly, if foods that are frequently used are stored in the multipurpose compartment 92, the utility thereof becomes high.

Further, although the forced draft fan 114 is disposed above the cooler 106, it does not violate the rear space of the vegetable compartment 148 and that of the multipurpose compartment 149. Accordingly, the storage container 156 of the vegetable compartment 149 and the storage container 158 of the multipurpose compartment 149 can be extended deep into the refrigerator body, making it possible to increase the storage capacity. In place of increasing the storage capacity, it is also possible to reduce the height of the vegetable compartment 148. In that case, because the vegetable compartment 148 becomes shallow and wide, the interior thereof can be easily seen and, hence, the piling up of vegetables is reduced, resulting in an easy-to-use vegetable compartment having a superior preserving ability.

Also, because it is not necessary to arrange the damper device 159 and the second damper device 160 at a location rearwardly of the low-temperature compartment 152 and the refrigerating compartment 147, a lower region of the refrigerating compartment that is easiest to use in terms of level can be fully utilized as far as a rear wall thereof, making it possible to realize an easy-to-use refrigerator.

(Embodiment 6)

Figure 14:
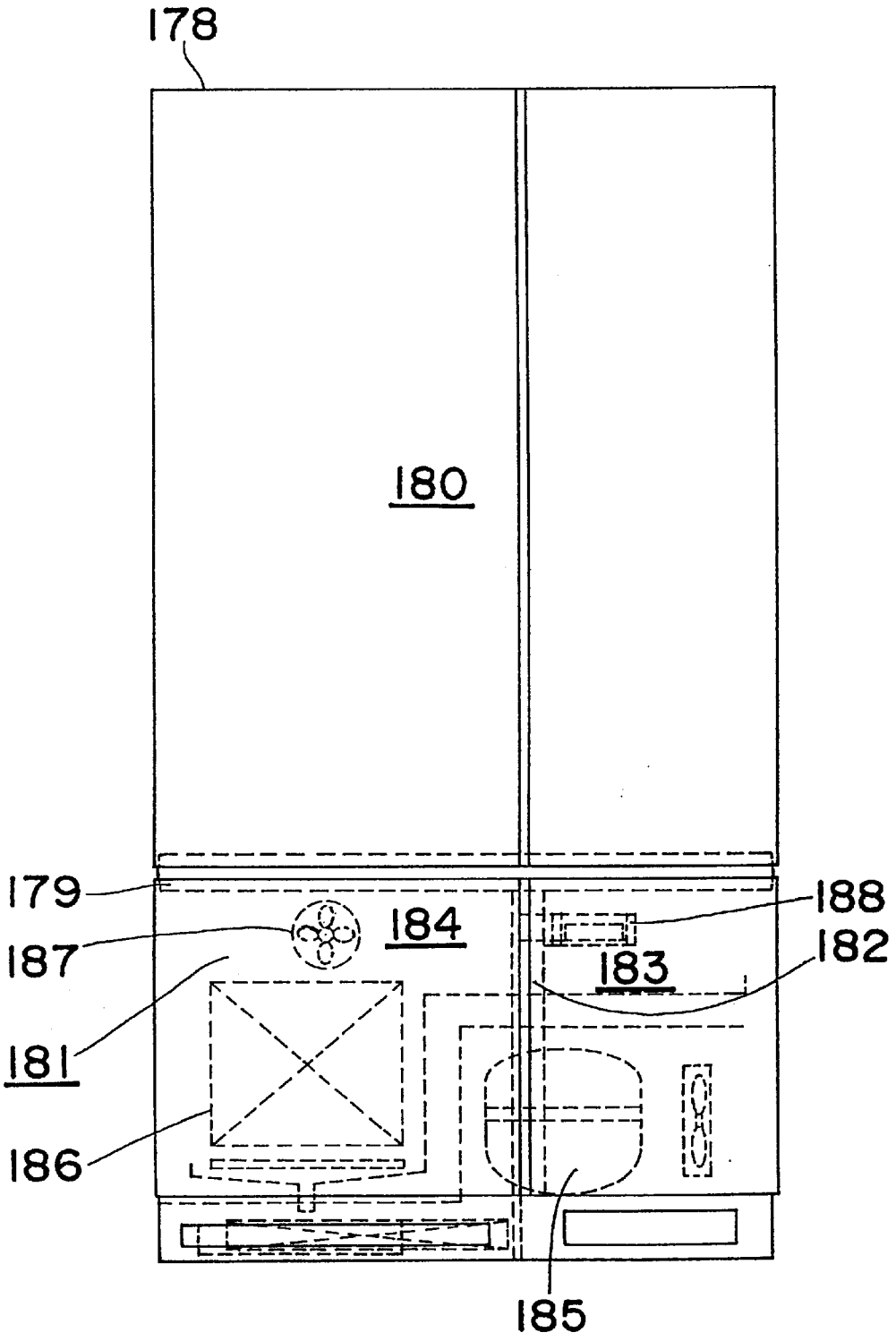
FIG. 14 is a front view of a refrigerator according to a sixth embodiment of the present invention.

FIG. 14 is a front view of a refrigerator according to a sixth embodiment of the present invention.

In FIG. 14, 178 denotes a refrigerator body, and 179 denotes a heat insulating partition wall for partitioning the interior of the refrigerator body 178 into upper and lower chambers. The upper chamber includes an upper storage compartment 180, while the lower chamber includes a lower storage compartment 181. 182 denotes a partition wall for vertically partitioning the lower storage compartment 181 into a first lower storage compartment 183 and a second lower storage compartment 184.

185 denotes a compressor of a refrigerating cycle, and 186 denotes a cooler. The compressor 185 and the cooler 186 are juxtaposed with each other in a side-by-side fashion at a location rearwardly of the lower storage compartment 181. 187 denotes a forced draft fan disposed adjacent to an upper portion of the cooler 186, and 188 denotes a damper device for controlling the amount of chilly air supplied to the upper storage compartment 180. The forced draft fan 187 and the damper device 188 are collectively disposed rearwardly of the lower storage compartment 181.

The above-described construction in which the two storage compartments are positioned on left and right sides is often applied to large and wide refrigerators and, hence, the compressor 185 and the cooler 186 are generally large. However, by arranging the compressor 185 and the cooler 186 in a side-by-side fashion over the full width of a region rearwardly of the lower storage compartment 181 irrespective of the position of the partition wall 182 between the two storage compartments, it becomes possible to collectively arrange the cooling functional elements including the forced draft fan 187 and the damper device 188.

This arrangement makes it possible to minimize an ineffectual space in the widthwise direction of the refrigerator, which space has hitherto been created by placing the cooler 186 above the compressor 185, thus increasing the effective storage capacity. This effect is particularly remarkable in wide refrigerators.

Moreover, although the forced draft fan 187 is disposed above the cooler 186, it does not violate a rear space of the upper storage compartment 180. Accordingly, a lower region of the upper storage compartment 180 that is easy to use in terms of level can be fully utilized as far as a rear wall thereof, making it possible to realize an easy-to-use refrigerator.

(Embodiment 7)

Figure 15:
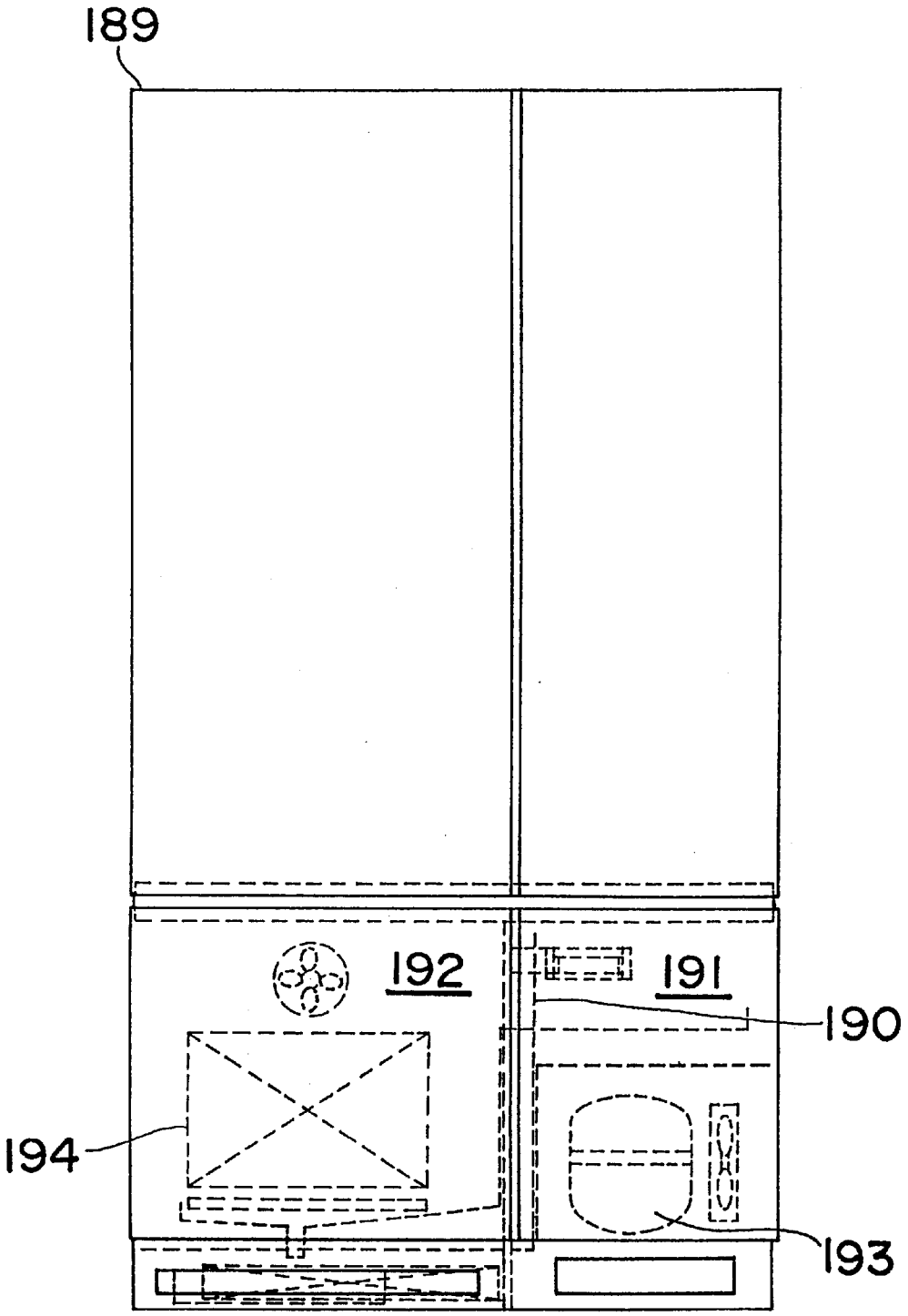
FIG. 15 is a front view of a refrigerator according to a seventh embodiment of the present invention.
Figure 16:
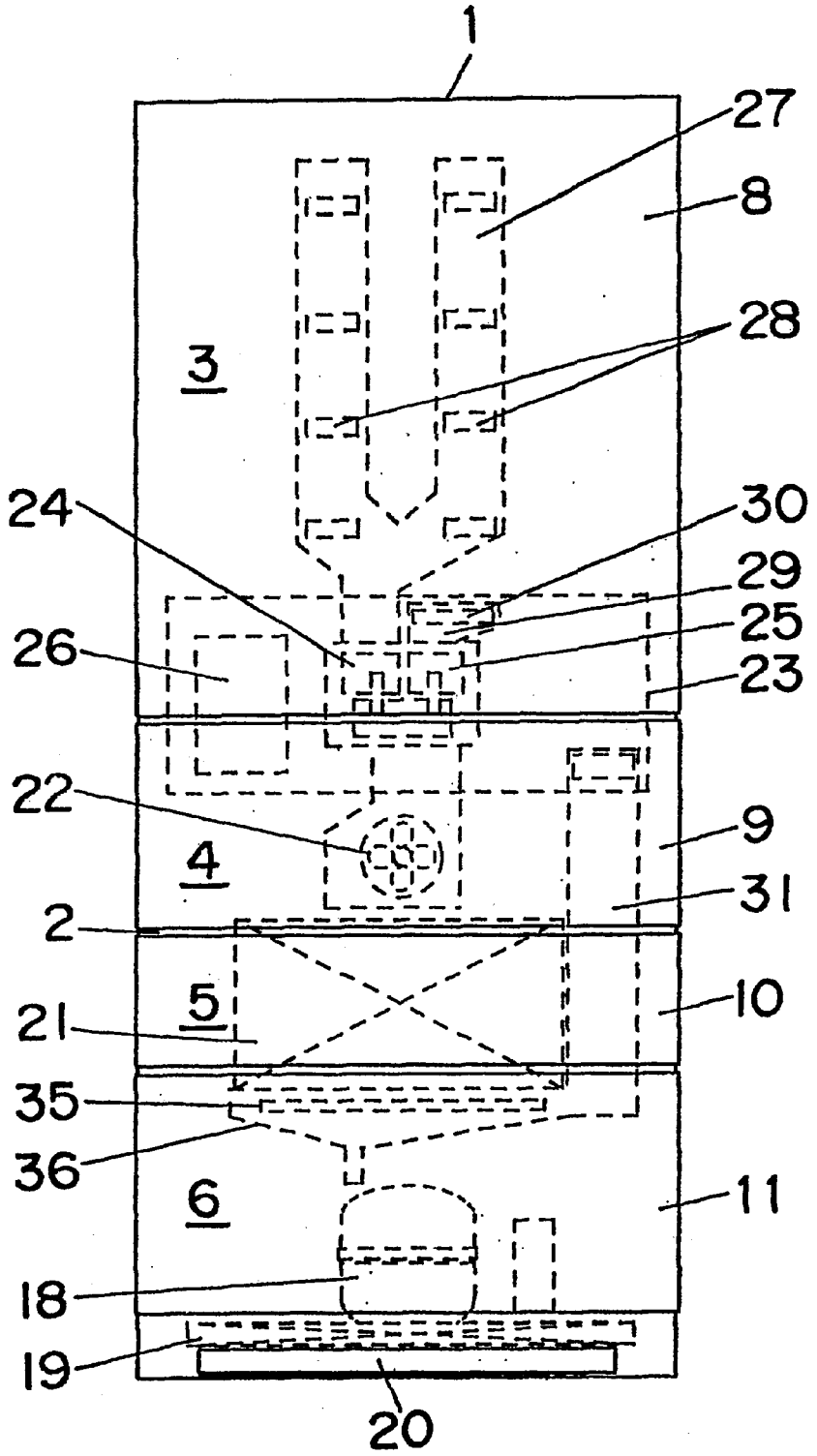
FIG. 16 is a front view of a conventional refrigerator.
Figure 17:
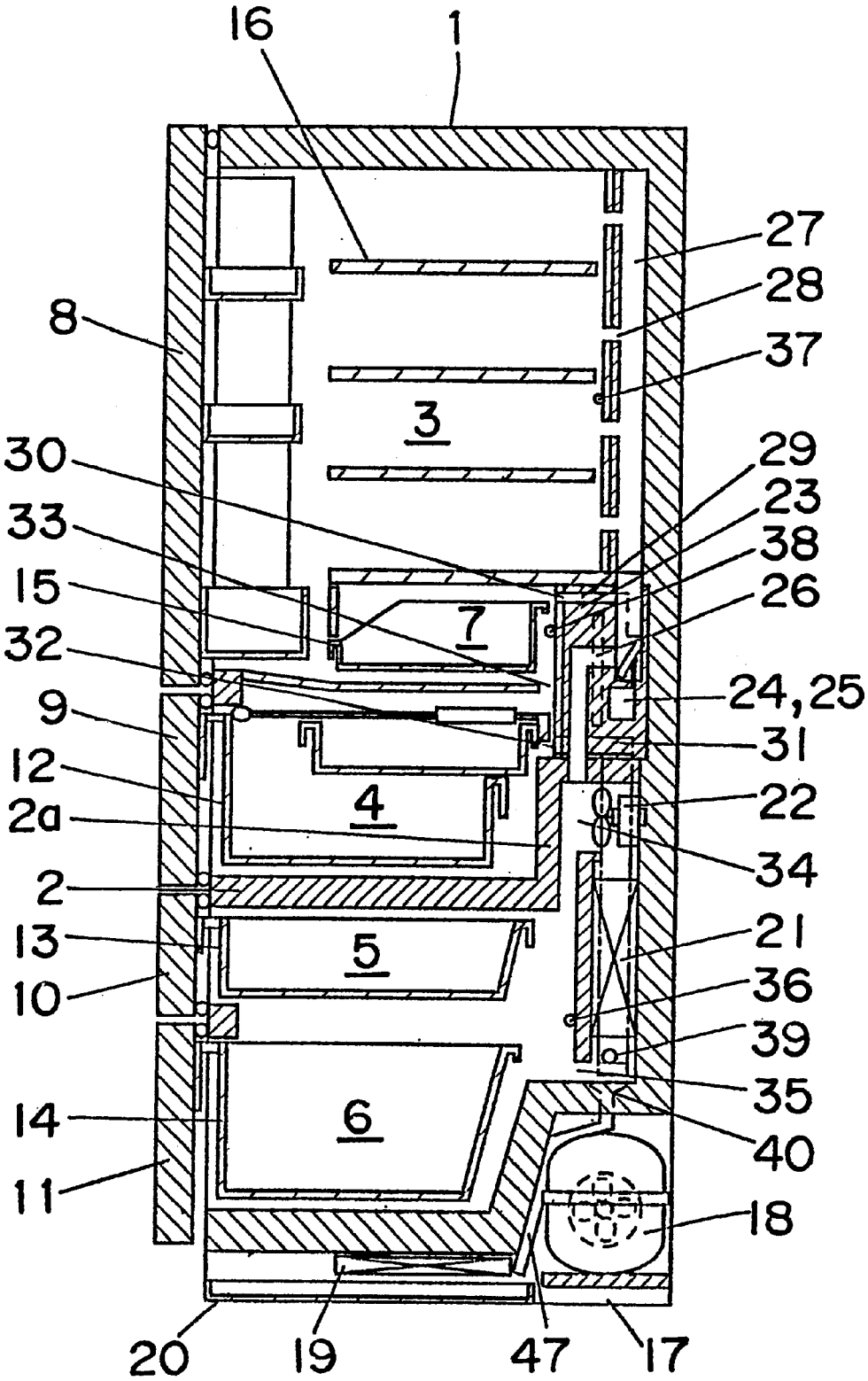
FIG. 17 is a vertical sectional view of the refrigerator of FIG. 16.

FIG. 15 is a front view of a refrigerator according to a seventh embodiment of the present invention.

In FIG. 15, 189 denotes a refrigerator body, and 190 denotes a partition wall for partitioning the interior of the lower storage compartment 181 into a first lower storage compartment 191 and a second lower storage compartment 192.

193 denotes a compressor of a refrigerating cycle, and 194 denotes a cooler. The compressor 193 is disposed at a location rearwardly of the first lower storage compartment 191, while the cooler 194 is juxtaposed with the compressor 193 in a side-by-side fashion at a location rearwardly of the second lower storage compartment 192.

In general, the portion where the compressor 193 is accommodated has a raised bottom and, hence, the storage compartment formed in front of it does not a sufficient capacity in most cases. In the above-described construction, however, the compressor 193 does not extend over the two storage compartments, but the position thereof is limited only behind the first lower storage compartment 191. Accordingly, the neighboring storage compartment, i.e., the second lower storage compartment 192 can be utilized to the full.

The first lower storage compartment 191 that does not have a sufficient capacity can be effectively utilized for storing small foods.

The side-by-side arrangement of the compressor 193 and he cooler 194 increases the inner volumetric efficiency and offers the same effect as in the other embodiments.

What is claimed is:

1. A refrigerator which comprises a refrigerating cycle including a compressor, a condenser and a cooler, and a refrigerator body having a storage compartment defined therein, characterized in that the compressor and the cooler are juxtaposed with each other in a side-by-side fashion at a location rearwardly of the storage compartment.

2. The refrigerator as claimed in claim 1, characterized in that the compressor and the coolers are positioned at a lower rear region of the storage compartment.

3. The refrigerator as claimed in claim 1, characterized in that there are further provided a machinery compartment and a cooling compartment positioned on left and right sides, respectively, with a heat insulating wall positioned therebetween, said compressor and said cooler being accommodated within the machinery compartment and the cooling compartment, respectively.

4. The refrigerator as claimed in claim 3, characterized in that a force draft fan is provided in the cooling compartment for supplying air to the storage compartment and is positioned rearwardly of the storage compartment provided with the cooler.

5. The refrigerator as claimed in claim 4, characterized in that a damper device is provided for controlling an amount of chilly air to be supplied to at least one of the storage compartments and is positioned rearwardly of the storage compartment confronting the compressor.

6. The refrigerator as claimed in claim 5, characterized in that the forced draft fan is disposed above the cooler and the damper device is disposed above the compressor.

7. The refrigerator as claimed in claim 6, characterized in that the forced draft fan is disposed adjacent to an upper portion of the cooler so as to extend obliquely upwardly.

8. The refrigerator as claimed in claim 5, characterized in that the plural storage compartments have at least refrigerating and freezing compartments, the damper device is provided for controlling an amount of chilly air to be supplied to said refrigerating compartment, and the compressor and the cooler are disposed rearwardly of the freezing compartment.

9. The refrigerator as claimed in claim 8, characterized in that the refrigerating compartment is formed at an upper portion of the refrigerator body and the freezing compartment is formed at a lower portion of the refrigerator body.

10. The refrigerator as claimed in claim 9, characterized in that a vegetable compartment is formed below the refrigerating compartment and an amount of chilly air to be supplied to the refrigerating compartment and the vegetable compartment is controlled by the damper device.

11. The refrigerator as claimed in claim 9, characterized in that the cooler is positioned rearwardly of the freezing compartment and the forced draft fan is disposed at a location upwardly rearwardly of the freezing compartment.

12. The refrigerator as claimed in claim 8, characterized in that a chilly air discharge duct communicating between the damper device and the refrigerating compartment is disposed vertically at a position adjacent one lateral end of a deep region of the refrigerating compartment and a chilly air suction duct leading to the cooler is disposed vertically at a position adjacent the opposite lateral end of the deep region of the refrigerating compartment.

13. The refrigerator as claimed in claim 12, characterized in that a chilly air discharge port provided in the chilly air discharge duct and a chilly air suction port provided in the chilly air suction duct are disposed adjacent respective lateral ends of the refrigerating compartment.

14. The refrigerator as claimed in claim 13, characterized in that there is provided a second forced draft fan for circulating air inside the refrigerating compartment.

15. The refrigerator as claimed in claim 3, characterized in that an electric component cover of the compressor is disposed so as to be oriented towards an open side rearwardly of the machinery compartment.

16. The refrigerator as claimed in claim 3, characterized in that an electric component cover of the compressor is disposed at a location laterally of the machinery compartment and in that there is provided an opening and a cover for covering the opening at a portion confronting the electric component cover.

17. The refrigerator as claimed in claim 3, characterized in that piping for the refrigerating cycle is accommodated rearwardly of an outdoor side of the cooling compartment.

18. The refrigerator as claimed in claim 17, characterized in that there is provided a fixture for fixing a dryer and a condenser piping of the refrigerating cycle to an outdoor rear surface of the refrigerating compartment.

19. The refrigerator as claimed in claim 3, characterized in that a resinous molded product is used for an external shell forming the machinery compartment.

20. The refrigerator as claimed in claim 19, characterized in that the resinous molded product used for the external shell forming the machinery compartment is formed integrally with a fixture for fixing a dryer and a condenser piping of the refrigerating cycle.

21. The refrigerator as claimed in claim 19, characterized in that the resinous molded product used for the external shell-forming the machinery compartment is formed integrally with a holder for holding the evaporating dish that accommodates defrosted water.

22. The refrigerator as claimed in claim 1, characterized in that the cooler and the compressor are positioned at different levels, with a bottom end surface of the cooler positioned at a level lower than an upper end surface of the compressor.

23. The refrigerator as claimed in claim 1, characterized in that an electronic control board is disposed rearwardly of the cooler.

24. The refrigerator as claimed in claim 23, characterized in that the electronic control board is accommodated within an electric component storage recess defined in a heat insulating wall rearwardly of the cooler.

25. The refrigerator as claimed in claim 1, characterized in that an evaporating dish is disposed below the cooler for receiving defrosted water from the cooler.

26. The refrigerator as claimed in claim 1, characterized in that an additional forced draft fan is provided for forcibly cooling the compressor within a machinery compartment.

27. The refrigerator as claimed in claim 26, characterized in that the condenser is disposed within the machinery compartment and is forcibly cooled by the additional forced draft fan.

28. The refrigerator as claimed in claim 27, characterized in that a portion of the condenser is disposed at a position where the evaporating dish is heated.

29. The refrigerator as claimed in claim 26, characterized in that the condenser is disposed at a bottom of the refrigerator body and is forcibly cooled by the additional forced draft fan.

30. The refrigerator as claimed in claim 26, characterized in that the evaporating dish is disposed in a passage for flow of the air induced by the force draft fan.

31. The refrigerator as claimed in claim 30, characterized in that the compressor is disposed upstream of the forced draft fan and the evaporating dish is disposed downstream of the forced draft fan and in that heat of the compressor is guided towards the evaporating dish.

32. A refrigerator which comprises a refrigerating cycle including a compressor, a condenser and a cooler, and a refrigerator body having a plurality of storage compartments defined therein, characterized in that the compressor and the cooler are juxtaposed with each other in a side-by-side fashion at a location rearwardly of one of the storage compartments.

33. The refrigerator as claimed in claim 32, characterized in that one of the storage compartments positioned forwardly of the compressor and the cooler is a lowermost storage compartment.

34. A refrigerator which comprises a refrigerating cycle including a compressor, a condenser and a cooler, and a refrigerator body having a plurality of storage compartments defined therein, two of which are positioned in a side-by-side fashion, characterized in that the compressor and the cooler are juxtaposed with each other at a location rearwardly of the two storage compartments.

35. The refrigerator as claimed in claim 34, characterized in that the compressor and the cooler are disposed rearwardly of the two storage compartments, respectively.

36. A refrigerator comprising a refrigerating compartment, a vegetable compartment defined below the refrigerating compartment, a freezing compartment partitioned from the vegetable compartment by a heat insulating partition wall disposed below the vegetable compartment, a machinery compartment defined adjacent one of opposite sides and rearwardly of the freezing compartment, a cooling compartment defined adjacent the other of the opposite sides and separated from the machinery compartment by a heat insulating wall, a compressor disposed within the machinery compartment, a cooler disposed within the cooling compartment, a forced draft fan disposed within the cooling compartment at a location adjacent an upper portion of the cooler, a damper device disposed rearwardly of the freezing compartment for controlling an amount of chilly air to be supplied to the refrigerating and vegetable compartments, and an electronic control board provided rearwardly of the cooling compartment, said compressor and said cooler being juxtaposed with each other in a side-by-side fashion.

37. The refrigerator as claimed in claim 36, characterized in that there are provided a multipurpose compartment defined above the heat insulating partition wall and a second damper device disposed rearwardly of the freezing compartment for controlling an amount of chilly air to be supplied to the multipurpose compartment.

38. The refrigerator as claimed in claim 37, characterized in that there are further provided a chilly air discharge duct extending vertically at a location adjacent one side end of a deep region of the refrigerating compartment in communication with the damper device, a chilly air discharge port provided in the chilly air discharge duct within the refrigerating compartment, a second chilly air discharge duct communicating between the second damper device and the multipurpose compartment, a chilly air discharge port provided in the second chilly air discharge port for the multipurpose compartment, a chilly air suction duct extending vertically at a location adjacent the opposite side end of the deep region of the refrigerating compartment for communicating between the refrigerating compartment and the cooler, a chilly air suction port provided in the chilly air suction duct within the refrigerating compartment, a chilly air suction port provided within the vegetable compartment in communication with the chilly air suction duct, a second chilly air suction duct communicating between the multipurpose compartment and the cooler, and a chilly air suction port provided in the multipurpose compartment and communicating with the second chilly air suction duct.

39. The refrigerator as claimed in claim 37, characterized in that there are further provided heat insulating partition walls above and below the multipurpose compartment, to thereby render it to be a temperture changeover compartment so that the temperature inside the multipurpose compartment can be adjusted to a value ranging from refrigeration to freezing.

40. The refrigerator as claimed in claim 36, characterized in that there are further provided a chilly air discharge duct extending vertically at a location adjacent one side end of a deep region of the refrigerating compartment in communication with the damper device, a chilly air discharge port provided in the chilly air discharge duct within the refrigerating compartment, a chilly air suction duct extending vertically at a location adjacent the opposite side end of the deep region of the refrigerating compartment for communicating between the refrigerating compartment and the cooler, a chilly air suction port provided in the chilly air suction duct within the refrigerating compartment, and a chilly air suction port provided within the vegetable compartment in communication with the chilly air suction duct.

* * * * *

UNITED STATES PATENT AND TRADEMARK OFFICE

CERTIFICATE OF CORRECTION

PATENT NO. : 6,629,429 B1
DATED : October 7, 2003
INVENTOR(S) : Takao Kawamura et al.

It is certified that error appears in the above-identified patent and that said Letters Patent is hereby corrected as shown below:

Title Page,
Item [22], "March 10, 1999" should read -- March 10, 2000 --; and
Item [86], "August 18, 2000" should read -- November 19, 2001 --.

Signed and Sealed this

Tenth Day of February, 2004

JON W. DUDAS
*Acting Director of the United States Patent and Trademark Office*